US011715428B2

(12) United States Patent
Heo et al.

(10) Patent No.: US 11,715,428 B2
(45) Date of Patent: Aug. 1, 2023

(54) PIXEL CIRCUIT AND DISPLAY DEVICE INCLUDING THE SAME

(71) Applicant: LG DISPLAY CO., LTD., Seoul (KR)

(72) Inventors: Seung Ho Heo, Paju-si (KR); Dong Hyun Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/947,786

(22) Filed: Sep. 19, 2022

(65) Prior Publication Data

US 2023/0096927 A1 Mar. 30, 2023

(51) Int. Cl.
*G09G 3/3266* (2016.01)
*G09G 3/3291* (2016.01)

(52) U.S. Cl.
CPC ..... *G09G 3/3291* (2013.01); *G09G 3/3266* (2013.01); *G09G 2300/0426* (2013.01); *G09G 2300/0852* (2013.01); *G09G 2310/0278* (2013.01)

(58) Field of Classification Search
None
See application file for complete search history.

(56) References Cited

U.S. PATENT DOCUMENTS

2012/0275207 A1* 11/2012 Houston ..... G11C 11/412 365/72
2014/0176402 A1* 6/2014 Lee ..... G09G 3/3233 345/77
2016/0104419 A1* 4/2016 Chung ..... G09G 3/3225 345/78
2016/0155385 A1* 6/2016 Yang ..... G06F 3/042 345/174
2018/0061913 A1* 3/2018 Kim ..... G09G 3/3225

FOREIGN PATENT DOCUMENTS

KR 10-2017-0134839 A 12/2017

* cited by examiner

*Primary Examiner* — Sepehr Azari
(74) *Attorney, Agent, or Firm* — Morgan, Lewis & Bockius LLP

(57) ABSTRACT

A pixel circuit and a display device including the same are disclosed. The pixel circuit includes: a first driving element including a first electrode connected to a 1-1 th node, a gate electrode connected to a 1-2 th node, and a second electrode connected to a 1-3 th node; and a second driving element including a first electrode connected to a 2-1 th node, a gate electrode connected to a 2-2 th node, and a second electrode connected to a second-third node. A second electrode voltage of the first driving element is transmitted to the gate electrode of the second driving element, and a second electrode voltage of the second driving element is transmitted to the gate electrode of the first driving element.

20 Claims, 24 Drawing Sheets

PIXEL CIRCUIT AND DISPLAY DEVICE INCLUDING THE SAME

CROSS-REFERENCE TO RELATED APPLICATION

This application claims priority to and the benefit of Korean Patent Application No. 10-2021-0127049, filed on Sep. 27, 2021, and Korean Patent Application No. 10-2021-0183519, filed on Dec. 21, 2021, the disclosures of which are incorporated herein by reference in its entirety.

BACKGROUND

1. Technical Field

The present disclosure relates to a pixel circuit and a display device including the same.

2. Discussion of the Related Art

An electroluminescence display device may be divided into an inorganic light emitting display device and an organic light emitting display device according to the material of the emission layer. The active matrix type organic light emitting display device includes an organic light emitting diode (hereinafter, referred to as "OLED") that emits light by itself, and has the advantage of fast response speed, high light-emitting efficiency, high luminance and wide viewing angle. In the organic light emitting display device, the OLED (Organic Light Emitting Diode) is formed in each pixel. The organic light emitting display device has a fast response speed, excellent light-emitting efficiency, luminance, and viewing angle, and has also excellent contrast ratio and color reproducibility because black gray scale can be expressed as complete black.

A pixel circuit of a field emission display device includes an OLED used as a light emitting element and a driving element for driving the OLED. The pixel circuit may sense a threshold voltage of the driving element to compensate for the threshold voltage variation according to the accumulation of driving time of the pixels. The pixel circuit may sense the threshold voltage of the driving element by using a source follower circuit or a diode connection circuit.

The pixel circuit having a source follower structure may sense the threshold voltage of the driving element smaller than 0 V and transmits the threshold voltage charged in a source node to a gate node through a capacitor. In the pixel circuit of the source follower structure, the sensing rate of the threshold voltage may be lowered according to the capacitance ratio of capacitors.

The pixel circuit having a diode connection structure may apply the threshold voltage to the gate node without lowering a threshold voltage sensing rate, but it is difficult to sense the threshold voltage of the driving element smaller than 0 V unless additional measures are taken.

SUMMARY

Accordingly, embodiments of the present disclosure are directed to a pixel circuit and a display device including the same that substantially obviate one or more of the problems due to limitations and disadvantages of the related art.

An aspect of the present disclosure is to solve the above-mentioned necessity and/or problems. Another aspect of the present disclosure is to provide a pixel circuit capable of sensing a threshold voltage smaller than 0 V and improving the reliability of a transistor, and a display device including the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a pixel circuit may comprise: a first driving element including a first electrode connected to a 1-1 th node, a gate electrode connected to a 1-2 th node, and a second electrode connected to a 1-3 th node; and a second driving element including a first electrode connected to a 2-1 th node, a gate electrode connected to a 2-2 th node, and a second electrode connected to a 2-3 th node.

A second electrode voltage of the first driving element may be transmitted to the gate electrode of the second driving element, and a second electrode voltage of the second driving element may be transmitted to the gate electrode of the first driving element.

In another aspect, a display device may comprise: a display panel on which a plurality of data lines, a plurality of gate lines, a plurality of power lines, and a plurality of pixels are arranged; a data driver configured to convert pixel data into data voltages and supply them to the data lines; and a gate driver configured to supply a gate pulse to the gate lines.

A first pixel in the plurality of pixels may include a first driving element including a first electrode connected to a 1-1 th node, a gate electrode connected to a 1-2 th node, and a second electrode connected to a 1-3 th node. A second pixel adjacent to the first pixel in the plurality of pixels may include a second driving element including a first electrode connected to a 2-1 th node, a gate electrode connected to a 2-2 th node, and a second electrode connected to a 2-3 th node. A second electrode voltage of the first driving element may be transmitted to the gate electrode of the second driving element. A second electrode voltage of the second driving element may be transmitted to the gate electrode of the first driving element.

According to the present disclosure, a threshold voltage of a driving element smaller than 0 V between adjacent pixels may be sensed using a characteristic of high uniformity between adjacent pixels, and the reliability of a transistor may be improved.

According to the present disclosure, since a sensing step can be set to a time of two horizontal periods or over, a threshold voltage sensing time of the driving element may be sufficiently secured. In the present disclosure, the threshold voltage of the driving element may be transmitted to the gate electrode of another adjacent driving element without lowering its sensing rate in the sensing step. Accordingly, the present disclosure may provide an advantage of the pixel circuit of a source follower structure and an advantage of the pixel circuit of a diode connection structure when sensing the threshold voltage of the driving element between adjacent pixels.

According to the present disclosure, by cross-applying data voltages to adjacent pixels and alternately driving EM switch elements, it is possible to offset a threshold voltage shift deviation of a driving element between the pixels and to reduce deterioration of the driving element and the EM switch elements.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
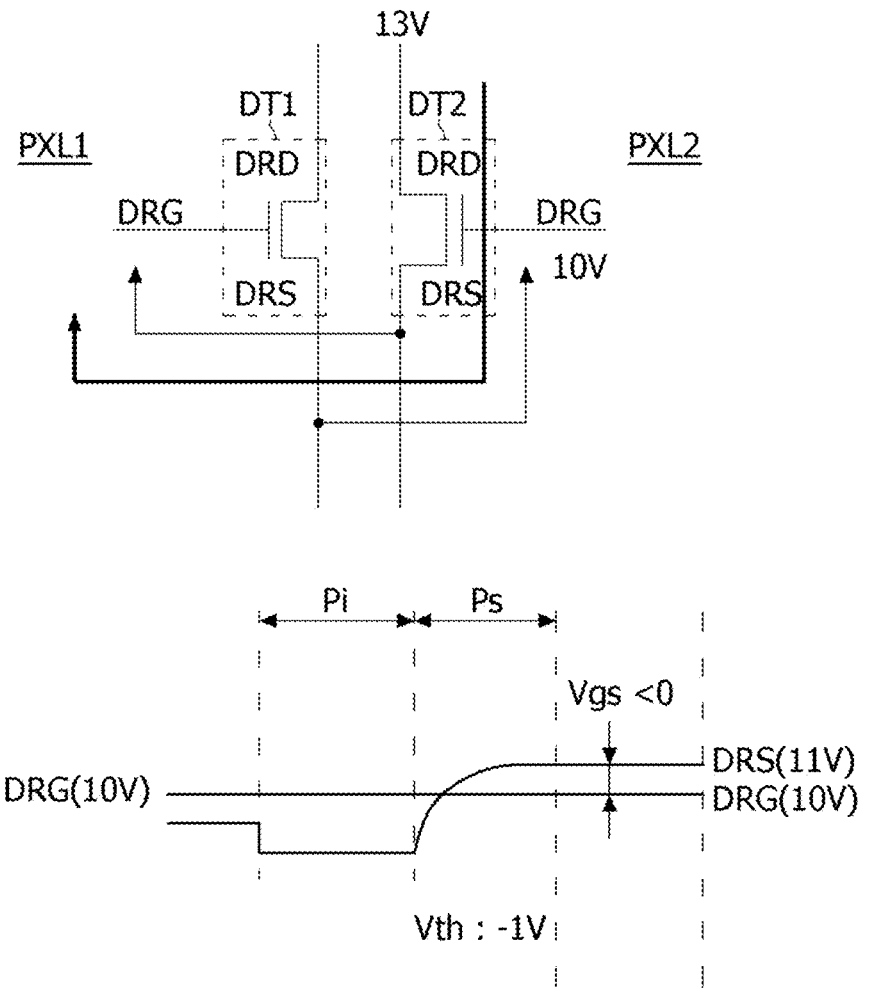
FIG. 1 is a diagram illustrating a method of sensing a threshold voltage of a driving element in a pixel circuit according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," "having," and "consist of" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The following embodiments can be partially or entirely bonded to or combined with each other and can be linked and operated in technically various ways. The embodiments can be carried out independently of or in association with each other.

Each of the pixels may include a plurality of sub-pixels having different colors to in order to reproduce the color of the image on a screen of the display panel. Each of the sub-pixels includes a transistor used as a switch element or a driving element. Such a transistor may be implemented as a TFT (Thin Film Transistor).

A driving circuit of the display device writes a pixel data of an input image to pixels on the display panel. To this end, the driving circuit of the display device may include a data driving circuit configured to supply data signal to the data lines, a gate driving circuit configured to supply a gate signal to the gate lines, and the like.

In the display device of the present disclosure, the pixel circuit may include a plurality of transistors. The transistor may be implemented as a thin film transistor (TFT), and may be an oxide TFT including an oxide semiconductor or a low temperature poly silicon (LTPS) TFT including LTPS. In the present disclosure, a driving element of each pixel is implemented with an n-channel oxide TFT implemented as the oxide TFT. In the pixels, a switch element except for the driving element is not limited to the oxide TFT.

Compared to the LTPS TFT, the oxide TFT has a similar threshold voltage of a transistor between pixels, so that the uniformity of the threshold voltage characteristic of the driving element is excellent over the entire screen. This is because, when a channel layer of the oxide TFT is manufactured based on an amorphous semiconductor, there may be a difference in threshold voltage between driving elements when viewed as a whole of the display panel, but there is little difference in the threshold voltage between pixels in the local area. In the LTPS TFT, a difference in the threshold voltage of the driving element between adjacent pixels may increase depending on a grain boundary position due to the characteristics of poly silicon.

In the present disclosure, the threshold voltage of the driving element is sensed using substantially the same or similar driving element characteristics between adjacent pixels each including the driving element made of the oxide TFT.

A transistor is a three-electrode element including a gate, a source, and a drain. The source is an electrode through which carriers are supplied to the transistor. In the transistor, carriers begin to flow from the source. The drain is an electrode through which carriers exit the transistor. In the transistor, carriers flow from the source to the drain. In the case of an n-channel transistor, since carriers are electrons, a source voltage is lower than a drain voltage so that electrons can flow from the source to the drain. In the n-channel transistor, a current flows from the drain to the source. In the case of a p-channel transistor, since carriers are holes, a source voltage is higher than a drain voltage so that holes can flow from the source to the drain. In the p-channel transistor, since holes flow from the source to the drain, a current flows from the source to the drain. It should be noted that the source and drain of the transistor are not fixed. For example, the source and the drain may be changed according to an applied voltage. Accordingly, the present disclosure is not limited by the source and drain of the transistor. In the following description, the source and drain of the transistor will be referred to as first and second electrodes.

A gate pulse may swing between a gate on voltage and a gate off voltage. The gate-on voltage is set higher than the threshold voltage of the transistor. The gate-off voltage is set lower than the threshold voltage of the transistor.

The transistor is turned on in response to the gate-on voltage, and turned off in response to the gate-off voltage. In the case of the n-channel transistor, the gate-on voltage may be a gate high voltage VGH and VEH, and the gate-off voltage may be a gate low voltage VGL and VEL.

Hereinafter, various embodiments of the present disclosure will be described in detail with reference to the accompanying drawings. In the following embodiments, the display device will be mainly described as an organic light emitting display device, but the present disclosure is not limited thereto.

FIG. 1 is a diagram illustrating a method of sensing a threshold voltage of a driving element in a pixel circuit according to an embodiment of the present disclosure. In adjacent sub-pixels of FIG. 1, "PXL'" is a left sub-pixel, and "PXL2" is a right sub-pixel. Hereinafter, the left sub-pixel PXL1 will be referred to as a first pixel PXL1 and the right sub-pixel PXL2 will be referred to as a second pixel PXL2. The first and second pixels include driving elements DT1 and DT2 for driving the light emitting element, respectively. The driving elements DT1 and DT2 are implemented with n-channel oxide TFTs.

Referring to FIG. 1, each of the driving elements DT1 and DT2 includes a gate electrode, a first electrode (or drain electrode), and a second electrode (or source electrode).

When a first driving element DT1 disposed in the first pixel PXL1 is turned on, a second electrode voltage (or source voltage) DRS of the first driving element DT1 increases, and the source voltage DRS is transmitted to the second pixel PXL2. When a second driving element DT2 disposed in the second pixel PXL2 is turned on, a second electrode voltage (or source voltage) DRS of the second driving element DT2 increases, and the source voltage DRS is transmitted to the first pixel PXL1.

Since the threshold voltages Vth of the first and second driving elements DT1 and DT2 are substantially the same, the threshold voltages of the driving elements DT1 and DT2 in the first and second pixels PXL1 and PXL2 may be accurately sensed. In particular, the threshold voltages Vth of the driving elements DT1 and DT2 may be sensed at a voltage greater than 0 V, and may be sensed even though they are negatively shifted to a voltage less than 0 V. In an example in which a gate voltage DRG of the second driving element DT2 is 10V and a drain voltage DRD thereof is 13V, when the threshold voltages Vth of the driving elements DT1 and DT2 is −1 V, the source voltage DRS of the second driving element DT2 rises to 11 V and then is transmitted to the first pixel PXL1. The threshold voltage Vth of the first driving element DT1 is sensed by a voltage difference between the gate voltage DTG of the first driving element DT1 and the source voltage DRS of the second driving element DT2. The threshold voltage Vth of the second driving element DT2 is sensed by a voltage difference between the gate voltage DTG of the second driving element DT2 and the source voltage DRS of the first driving element DT1. In FIG. 1, "Vgs<0" indicates that a gate-source voltage of the driving elements DT1 and DT2 is less than 0 V.

Figure 2:
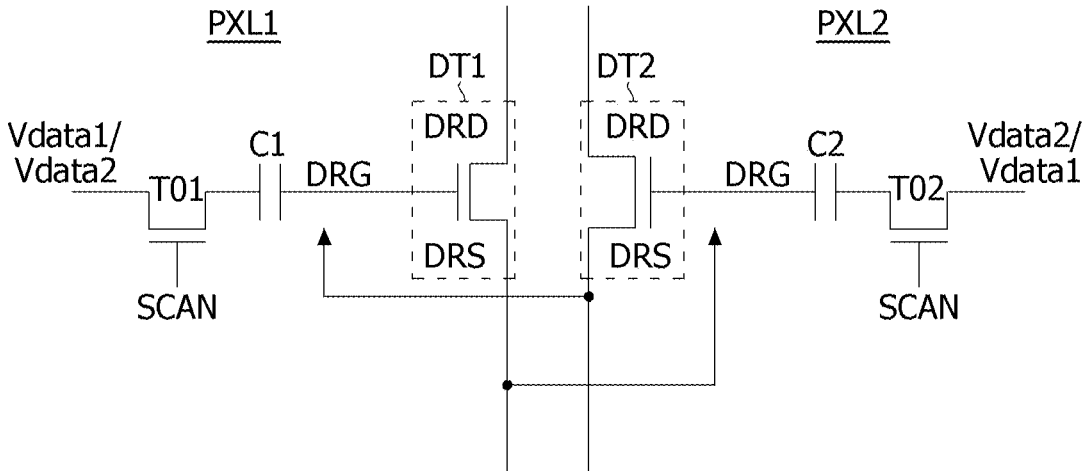
FIG. 2 is a diagram illustrating a method of writing pixel data in a pixel circuit according to an embodiment of the present disclosure.

FIG. 2 is a diagram illustrating a method of writing pixel data in a pixel circuit according to an embodiment of the present disclosure. Sensing the threshold voltage of the driving element and writing pixel data are separated on a time axis.

Referring to FIG. 2, a data voltage Vdata1 of pixel data to be written into the first pixel PXL1 is applied to the gate electrode of the first driving element DT1 through a capacitor C1. A switch element T01 of the first pixel circuit PXL1 is connected between a data line and the gate electrode of the first driving element DT1. The switch element T01 supplies the data voltage Vdata1 to the capacitor C1 in response to a scan pulse SCAN.

A data voltage Vdata2 of pixel data to be written into the second pixel PXL2 is applied to the gate electrode of the second driving element DT2 through a capacitor C2. A switch element T02 of the second pixel circuit PXL2 is connected between the data line and the gate electrode of the second driving element DT2. The switch element T02 supplies the data voltage Vdata2 to the capacitor C2 in response to the scan pulse SCAN.

Figure 3:
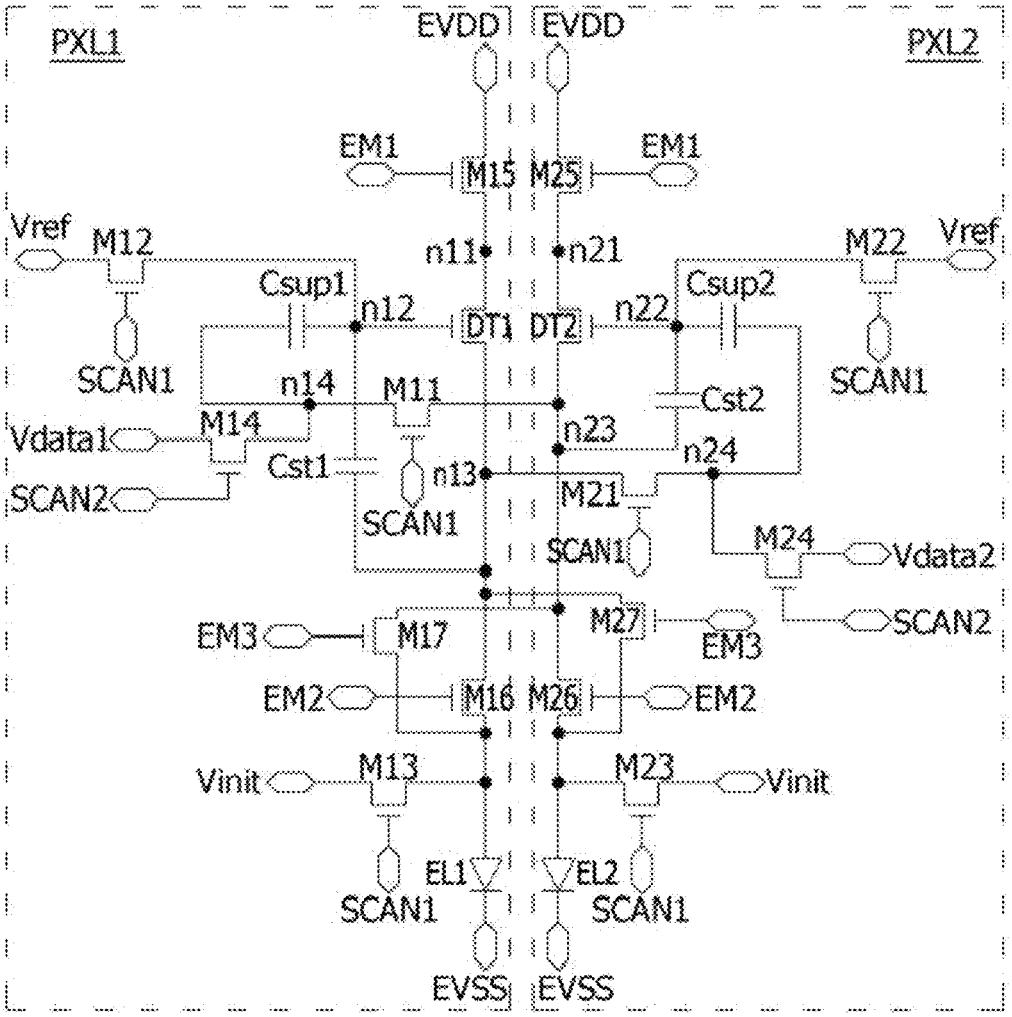
FIG. 3 is a circuit diagram illustrating a pixel circuit of adjacent pixels according to a first embodiment of the present disclosure.
Figure 4:
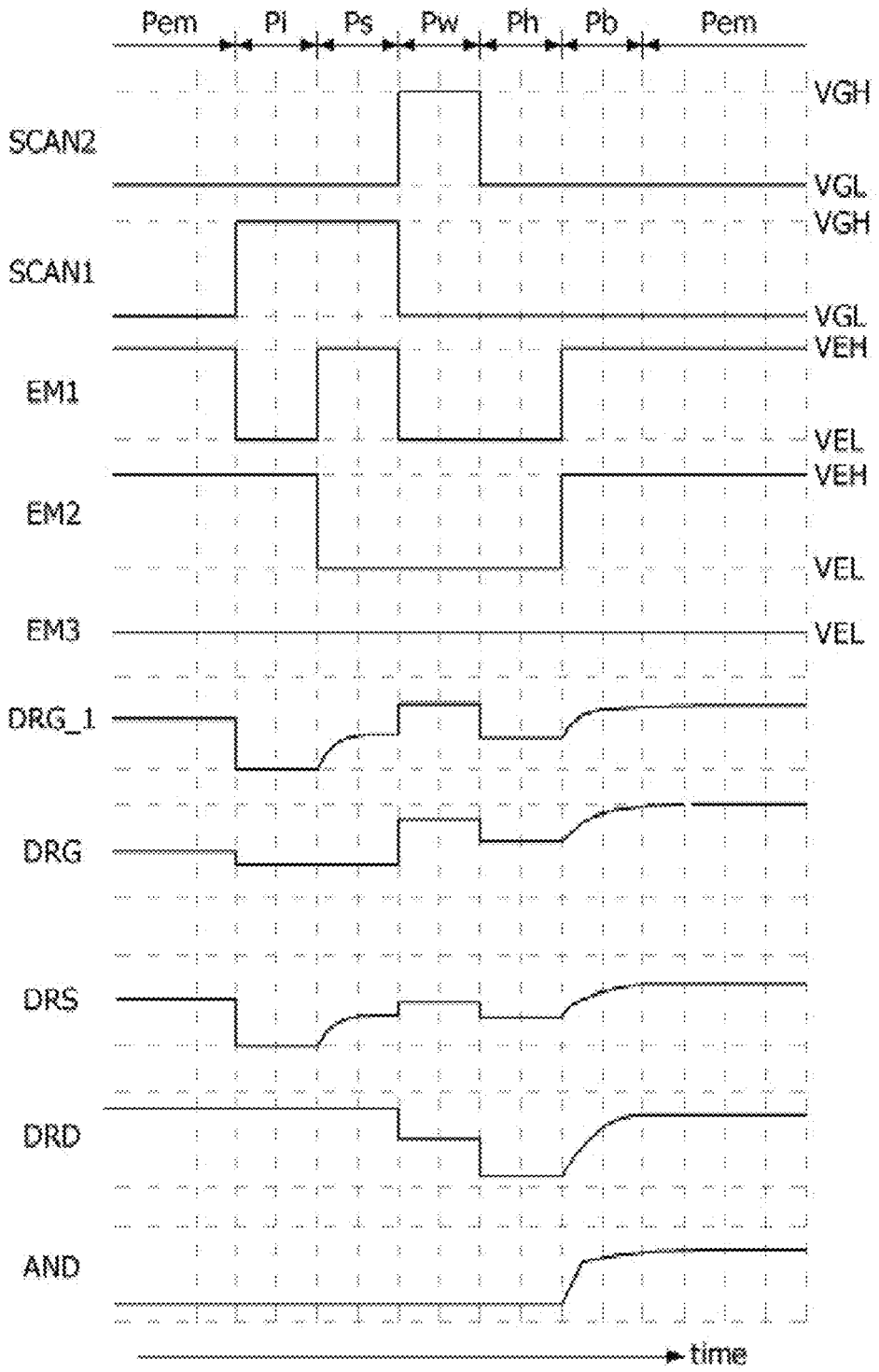
FIG. 4 is a waveform diagram illustrating a gate pulse applied to the pixel circuit shown in FIG. 3 and voltages of main nodes.

FIG. 3 is a circuit diagram illustrating a pixel circuit of adjacent pixels according to a first embodiment of the present disclosure. FIG. 4 is a waveform diagram illustrating a gate pulse applied to the pixel circuit shown in FIG. 3 and voltages of main nodes. In FIG. 4, "DRG" is a voltage of 1-2 th and 2-2 th nodes n12 and n22, i.e., the gate voltage of the driving elements DT1 and DT2. "DRS" is a voltage of 1-3 th and 2-3 th nodes n13 and n23, i.e., the source voltage of the driving elements DT1 and DT2. "DRG 1" is a voltage of the 1-4 th and 2-4 th nodes n14 and n24. "AND" is an anode voltage of light emitting elements EL1 and EL2.

Referring to FIGS. 3 and 4, the first pixel PXL1 includes a first light emitting element EL1, the first driving element DT1, 1-1 th to 1-7 th switch elements M11 to M17, and 1-1 th and 1-2 th capacitors Csup1 and Cst1. The second pixel PXL2 includes a second light emitting element EL2, the second driving element DT2, 2-1 th to 2-7 th switch elements M21 to M27, and 2-1 th and 2-2 th capacitors Csup2 and Cst2. The driving elements DT1 and DT2 and the switch elements M11 to M27 may be implemented with n-channel oxide TFTs.

The first and second pixels PXL1 and PXL2 share power lines through which constant voltages EVDD, EVSS, Vref, and Vinit are applied, and gate lines through which gate pulses SCAN1, SCAN2, EM1, EM2, EM3 are applied. The first and second pixels PXL1 and PXL2 are connected to different data lines. The first pixel PXL1 may be connected to a first data line through which a first data voltage Vdata1 is applied. The second pixel PXL2 may be connected to a second data line through which a second data voltage Vdata2 is applied.

The power lines may include a VDD line through which a pixel driving voltage EVDD is applied, a VSS line through which a pixel reference voltage EVSS is applied, an INIT line through which an initialization voltage Vinit is applied, a REF line through which a reference voltage Vref is applied, and the like. The pixel driving voltage EVDD is higher than the maximum voltage of the data voltages Vdata1 and Vdata2. The reference voltage Vref is lower than the minimum voltage of the data voltages Vdata1 and Vdata2. The pixel reference voltage EVSS and the initialization voltage Vinit are lower than the reference voltage Vref. The pixel reference voltage EVSS and the initialization voltage Vinit may be set to the same voltage or set to different voltages.

The data voltages Vdata1 and Vdata2 may be determined according to the grayscale of the pixel data in a dynamic range of 5 V to 10 V. In this case, the pixel driving voltage EVDD may be set to a constant voltage within a range of 13 V to 16 V, the pixel reference voltage EVSS may be set to a constant voltage of 0 V to 2 V, the reference voltage Vref may be set to a constant voltage of 3.0 V, and the initialization voltage Vinit may be set to a constant voltage of 0 V to 2 V, but they are not limited thereto.

The gate pulses SCAN1, SCAN2, EM1, EM2, and EM3 are generated at pulses swinging between the gate-on voltages VGH and VEH and the gate-off voltages VGL and VEL. The gate-on voltages VGH and VEH may be set to be higher than the pixel driving voltage EVDD. The gate-off voltages VGL and VEL may be set to be lower than the pixel reference voltage EVSS. The gate pulses SCAN1, SCAN2, EM1, EM2, and EM3 include a first scan pulse SCAN1 applied to a first gate line, a second scan pulse SCAN2 applied to a second gate line, a first discharge control pulse (hereinafter, referred to as "EM" pulse) EM1 applied to a third gate line, a second EM pulse EM2 applied to a fourth gate line, and a third EM pulse EM3 applied to a fifth gate line. A gate driver of the display device may include a first shift register generating the first scan pulse SCAN1, a second shift register generating the second scan pulse SCAN2, a third shift register generating the first EM pulse, a fourth shift register generating the second EM pulse, and a fifth shift register generating the third EM pulse.

The driving period of the pixel circuit may, as shown in FIG. 4, be divided into an initialization step Pi, a sensing step Ps, a data writing step Pw, a boosting step Pb, and an light emission step Pem. A hold step Ph may be set between the data writing step Pw and the boosting step Pb.

In the initialization step Pi, as shown in FIG. 4, the first scan pulse SCAN1 and the second EM pulse EM2 are generated at the gate-on voltages VGH and VEH. In the initialization step Pi, the second scan pulse SCAN2, the first EM pulse EM1, and the third EM pulse EM3 are at the gate-off voltages VGL and VEL.

In the sensing step Ps, as shown in FIG. 4, the first scan pulse SCAN1 and the first EM pulse EM1 are generated at the gate-on voltages VGH and VEH. The second scan pulse SCAN2, the second EM pulse EM2, and the third EM pulse EM3 are at the gate-off voltages VGL and VEL in the sensing step Ps.

In the data writing step Pw, as shown in FIG. 4, the second scan pulse SCAN2 is generated at the gate-on voltage VGH synchronized with the data voltages Vdata1 and Vdata2 of the pixel data. The gate pulses SCAN1, EM1, EM2, and EM3 other than the second scan pulse SCAN2 are generated at the gate-off voltages VGL and VEL in the data writing step Pw.

In the hold step Ph, all the gate pulses SCAN1, SCAN2, EM1, EM2, and EM3 are at the gate-off voltages VGL and VEL. In this case, the main nodes n11 to n14 and n21 to n24 of the pixel circuit are floated to maintain their voltages.

In the boosting step Pb and the light emission step Pem, as shown in FIG. 4, the first and second EM pulses EM1 and EM2 are at the gate-on voltages VEH, while the first and second scan pulses SCAN1 and SCAN2 and the third EM pulse EM3 are at the gate-off voltages VGL.

The light emitting elements EL1 and EL2 may be implemented with OLEDs. The OLED includes an organic compound layer formed between an anode electrode and a cathode electrode. The organic compound layer may include a hole injection layer (HIL), a hole transport layer (HTL), an emission layer (EML), an electron transport layer (ETL), and an electron injection layer (EIL), but is not limited thereto. When a voltage is applied to the anode and cathode electrodes of the OLED, holes passing through the hole transport layer (HTL) and electrons passing through the electron transport layer (ETL) move to the emission layer (EML) to form excitons. In this case, visible light is emitted from the emission layer (EML). An organic light-emitting diode (OLED) used as the light-emitting element EL may be of a tandem structure in which a plurality of light-emitting layers are stacked. An OLED of the tandem structure can improve the luminance and lifespan of pixels.

Figure 17A:
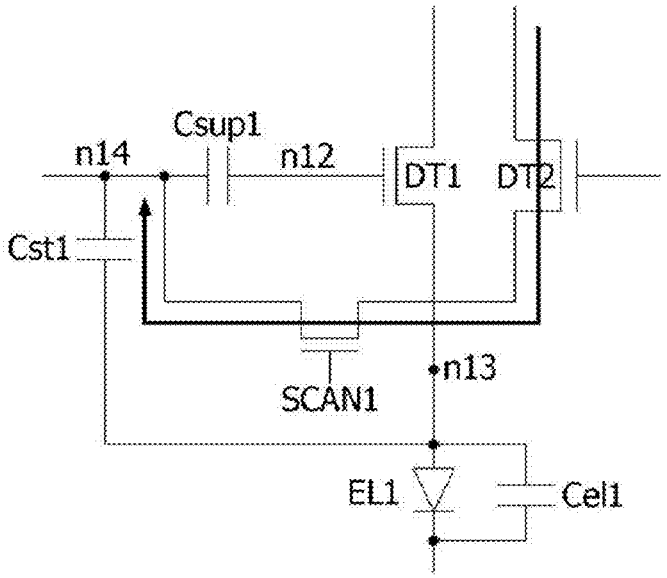
FIGS. 17A and 17B are circuit diagrams illustrating various examples of a capacitor connection structure of a pixel circuit.
Figure 17B:
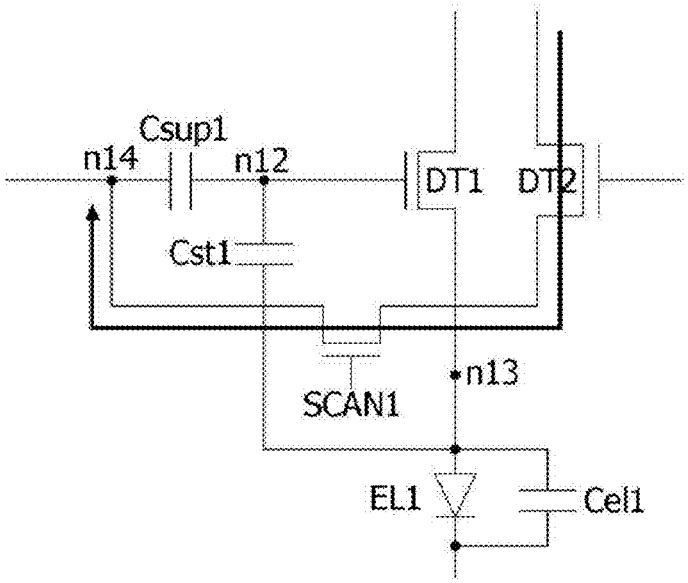

The anode electrodes of the light emitting elements EL1 and EL2 are connected to the driving elements DT1 and DT2 with the switch elements M16, M17, M26, and M27 interposed therebetween. When the switch elements M16, M17, M26, and M27 are turned on, the anode electrodes of the light emitting elements EL1 and EL2 are connected to the driving elements DT1 and DT2, so that the light emitting elements EL1 and EL2 may emit light by a current from the driving elements DT1 and DT2. The cathode electrodes of the light emitting elements EL1 and EL2 are connected to the VSS line through which the pixel reference voltage EVSS is applied. Each of the light emitting elements EL1 and EL2 includes, as shown in FIGS. 17A and 17B, a capacitor Cel1 connected between an anode electrode and a cathode electrode.

In the first pixel PXL1, the first driving element DT1 generates a current according to the gate-source voltage Vgs to drive the first light emitting element EL1. The first driving element DT1 includes a first electrode connected to the 1-1 th node n11, a gate electrode connected to the 1-2 th node n12, and a second electrode connected to the 1-3 th node n13.

The 1-1 th capacitor Csup1 is connected between the 1-2 th node n12 and the 1-4 th node n14 to transmit the data voltage Vdata1 of the pixel data to the 1-2 th node n12. The 1-2 th capacitor Cst1 is connected between the 1-2 th node n12 and the 1-3 th node n13 to store the gate-source voltage Vgs of the first driving element DT1. The capacitances of the 1-1 th capacitor Csup1 and the 1-2 th capacitor Cst1 may be set to the same value or different values.

The 1-1 th switch element M11 is turned on in response to the gate-on voltage VGH of the first scan pulse SCAN1 in the initialization step Pi and the sensing step Ps to connect the 1-4 th node n14 to the 2-3 th node n23 of the second pixel PXL2. The 1-1 th switch element M11 includes a gate electrode connected to the first gate line through which the first scan pulse SCAN1 is applied, a first electrode connected to the 1-4 th node n14, and a second electrode connected to the 2-3 th node n23.

The 1-2 th switch element M12 is turned on in response to the gate-on voltage VGH of the first scan pulse SCAN1 in the initialization step Pi and the sensing step Ps to supply the reference voltage Vref to the 1-2 th node n12. The 1-2 th switch element M12 includes a gate electrode connected to the first gate line through which the first scan pulse SCAN1 is applied, a first electrode connected to the REF line through which the reference voltage Vref is applied, and a second electrode connected to the 1-2 th node n12.

The first-third switch element M13 is turned on in response to the gate-on voltage VGH of the first scan pulse SCAN1 in the initialization step Pi and the sensing step Ps to supply the initialization voltage Vinit to the anode electrode of the first light emitting element EL1. The 1-3 th switch element M13 includes a gate electrode connected to the first gate line through which the first scan pulse SCAN1 is applied, a first electrode connected to the INIT line through which the initialization voltage Vinit is applied, and a second electrode connected to the anode electrode of the first light emitting element EL1.

The 1-4 th switch element M14 is turned on in response to the gate-on voltage VGH of the second scan pulse SCAN2 synchronized with the data voltage Vdata1 of the pixel data in the data writing step Pw to supply the data voltage Vdata1 to the 1-4 th node n14. The 1-4 th switch element M14 includes a gate electrode connected to the second gate line through which the second scan pulse SCAN2 is applied, a first electrode connected to the first data line through which the data voltage Vdata1 is applied, and a second electrode connected to the 1-4 th node n14.

The 1-5 th switch element M15 is turned on in response to the gate-on voltage VEH of the first EM pulse EM1 in the sensing step Ps, the boosting step Pb, and the light emission step Pem to supply the pixel driving voltage EVDD to the 1-1 th node n11. The 1-5 th switch element M15 includes a gate electrode connected to the third gate line through which the first EM pulse EM1 is applied, a first electrode connected to the VDD line through which the pixel driving voltage EVDD is applied, and a second electrode connected to the 1-1 th node n11.

The 1-6 th switch element M16 is turned on in response to the gate-on voltage VEH of the second EM pulse EM2 in the initialization step Pi, the boosting step Pb, and the light emission step Pem to connect the 1-3 th node n13 to the anode electrode of the first light emitting element EL1. The 1-6 th switch element M16 includes a gate electrode connected to the fourth gate line through which the second EM pulse EM2 is applied, a first electrode connected to the 1-3 th node n13, and a second electrode connected to the anode electrode of the first light emitting element EL1.

A threshold voltage shift deviation of the driving elements DT1 and DT2 may occur between adjacent pixels PXL1 and PXL2, and in order to offset the threshold voltage shift deviation, the 1-7 th switch element M17 may be used when the data voltages Vdata1 and Vdata2 are cross-applied between the pixels PXL1 and PXL2 on the time axis. The 1-7 th switch element M17 includes a gate electrode connected to the fifth gate line through which the third EM pulse EM3 is applied, a first electrode connected to the 2-3 th node n23, and a second electrode connected to the anode electrode of the first light emitting element EL1. When the data voltages Vdata1 and Vdata2 are not cross-applied between the pixels PXL1 and PXL2, as shown in FIG. 4, the third EM pulse EM3 maintains the gate-off voltage VEL, so that the 1-7 th switch element M17 is in an OFF state. The 1-7 th switch element M17 may be omitted as shown in FIGS. 18 to 21.

In the second pixel PXL2, the second driving element DT2 generates a current according to the gate-source voltage Vgs to drive the second light emitting element EL2. The second driving element DT2 includes a first electrode connected to the 2-1 th node n21, a gate electrode connected to the 2-2 th node n22, and a second electrode connected to the 2-3 th node n23.

The 2-1 th capacitor Csup2 is connected between the 2-2 th node n22 and the second-fourth node n24 to transmit the data voltage Vdata2 of the pixel data to the 2-2 th node n22. The 2-2 th capacitor Cst2 is connected between the 2-2 th node n22 and the 2-3 th node n23 to store the gate-source voltage Vgs of the second driving element DT2. The capacitances of the 2-1 th capacitor Csup2 and the 2-2 th capacitor Cst2 may be set to the same value or different values.

The 2-1 th switch element M21 is turned on in response to the gate-on voltage VGH of the first scan pulse SCAN1 in the initialization step Pi and the sensing step Ps to connect the 2-4 th node n24 to the 1-3 th node n13 of the first pixel PXL1. The 2-1 th switch element M21 includes a gate electrode connected to the first gate line through which the first scan pulse SCAN1 is applied, a first electrode connected to the 2-4 th node n24, and a second electrode connected to the 1-3 th node n13.

The 2-2 th switch element M22 is turned on in response to the gate-on voltage VGH of the first scan pulse SCAN1 in the initialization step Pi and the sensing step Ps to supply the reference voltage Vref to the 2-2 th node n22. The 2-2 th switch element M22 includes a gate electrode connected to the first gate line through which the first scan pulse SCAN1 is applied, a first electrode connected to the REF line through which the reference voltage Vref is applied, and a second electrode connected to the 2-2 th node n22.

The 2-3 th switch element M23 is turned on in response to the gate-on voltage VGH of the first scan pulse SCAN1 in the initialization step Pi and the sensing step Ps to supply the initialization voltage Vinit to the anode electrode of the second light emitting element EL2. The 2-3 th switch element M23 includes a gate electrode connected to the first gate line through which the first scan pulse SCAN1 is applied, a first electrode connected to the INIT line through which the initialization voltage Vinit is applied, and a second electrode connected to the anode electrode of the second light emitting element EL2.

The 2-4 th switch element M24 is turned on in response to the gate-on voltage VGH of the second scan pulse SCAN2 synchronized with the data voltage Vdata2 of the pixel data in the data writing step Pw to supply the data voltage Vdata2 to the 2-4 th node n24. The 2-4 th switch element M24 includes a gate electrode connected to the second gate line through which the second scan pulse SCAN2 is applied, a first electrode connected to the second data line through which the data voltage Vdata2 is applied, and a second electrode connected to the 2-4 th node n24.

The 2-5 th switch element M25 is turned on in response to the gate-on voltage VEH of the first EM pulse EM1 in the sensing step Ps, the boosting step Pb, and the light emission step Pem to supply the pixel driving voltage EVDD to the 2-1 th node n21. The 2-5 th switch element M25 includes a gate electrode connected to the third gate line through which the first EM pulse EM1 is applied, a first electrode connected to the VDD line through which the pixel driving voltage EVDD is applied, and a second electrode connected to the 2-1 th node n21.

The 2-6 th switch element M26 is turned on in response to the gate-on voltage VEH of the second EM pulse EM2 in the initialization step Pi, the boosting step Pb, and the light emission step Pem to connect the 2-3 th node n23 to the anode electrode of the second light emitting element EL2. The 2-6 th switch element M26 includes a gate electrode connected to the fourth gate line through which the second EM pulse EM2 is applied, a first electrode connected to the 2-3 th node n23, and a second electrode connected to the anode electrode of the second light emitting element EL2.

A threshold voltage shift deviation of the driving elements DT1 and DT2 may occur between adjacent pixels PXL1 and PXL2, and in order to offset the threshold voltage shift deviation, the 2-7 th switch element M27 may be used when the data voltages Vdata1 and Vdata2 are cross-applied between the pixels PXL1 and PXL2. The 2-7 th switch element M27 includes a gate electrode connected to the fifth gate line through which the third EM pulse EM3 is applied, a first electrode connected to the 1-3 th node n13, and a second electrode connected to the anode electrode of the second light emitting element EL2. When the data voltages Vdata1 and Vdata2 are not cross-applied between the pixels PXL1 and PXL2, as shown in FIG. 4, the third EM pulse EM3 maintains the gate-off voltage VEL, so that the 2-7 th switch element M27 is in an OFF state. The 2-7 th switch element M27 may be omitted as shown in FIGS. 18 to 21.

Figure 5:
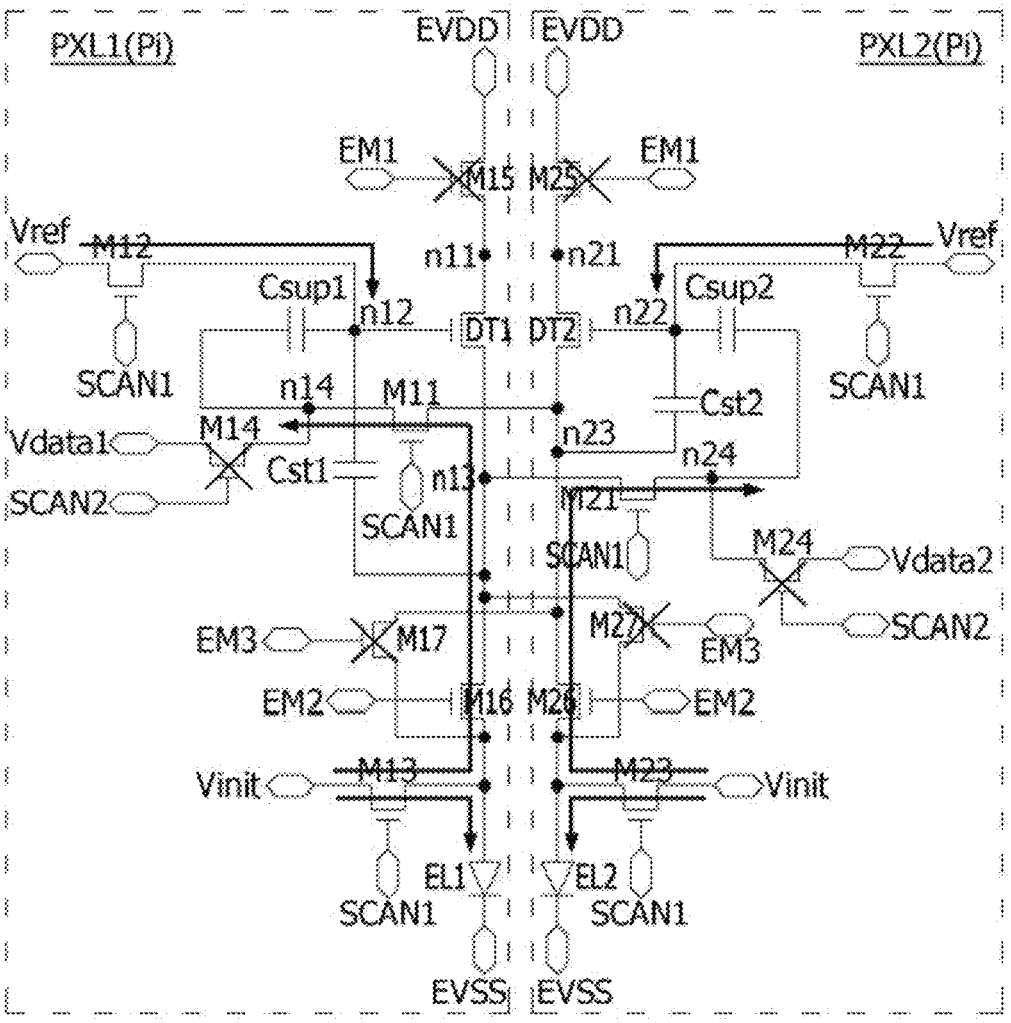
FIGS. 5 and 6 are diagrams illustrating an initialization step of the pixel circuit shown in FIG. 3.
Figure 6:
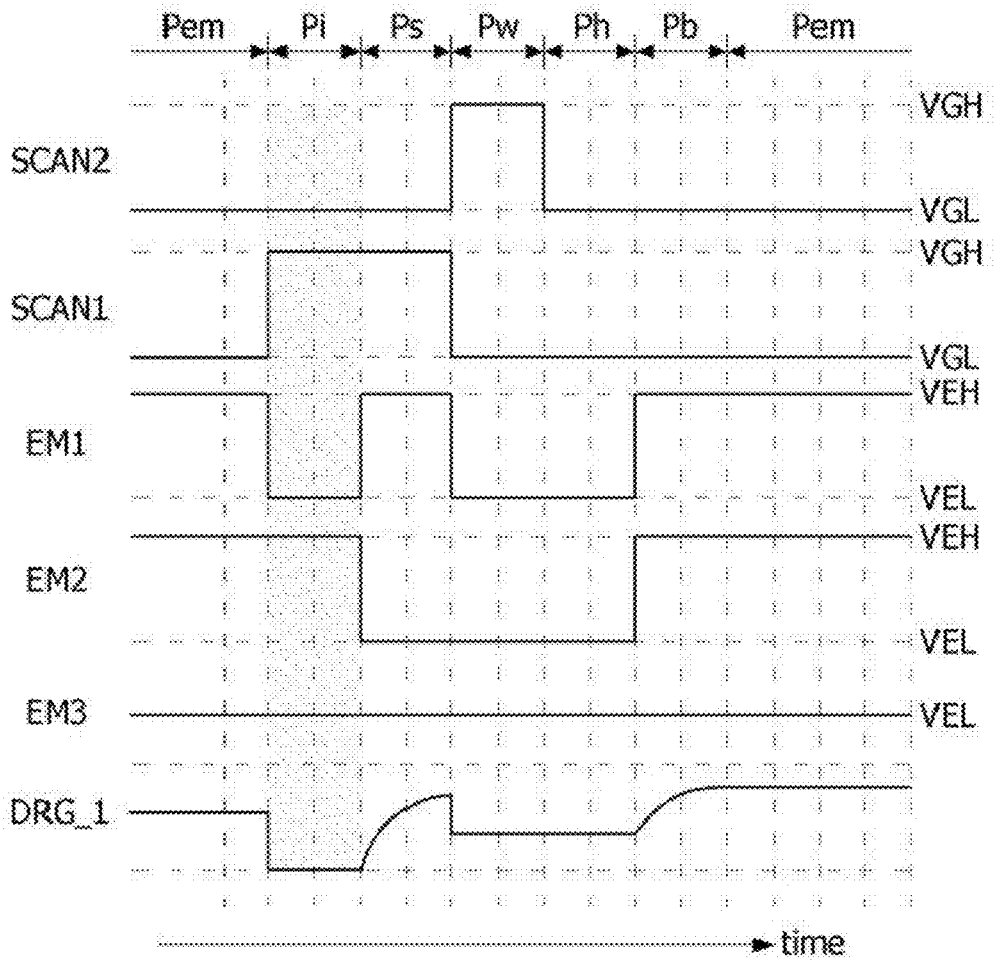

In the initialization step Pi, as shown in FIGS. 5 and 6, the 1-1 th, 1-2 th, 1-3 th, 1-6 th, 2-1 th, 2-2 th, 2-3 th, and 2-6 th switch elements M11, M12, M13, M16, M21, M22, M23, and M26 and the driving elements DT1 and DT2 are turned on, and the other switch elements M14, M15, M17, M24, M25, and M27 are turned off. At this time, the light emitting elements EL1 and EL2 are not turned on. In the initialization step Pi, the main nodes n12, n13, n14, n22, n23, and n24, the capacitors Csup1, Cst1, Csup2, and Cst2, and the light emitting elements EL1 and EL2 of the pixel circuit are initialized. In the initialization step Pi, the voltages at the 1-2 th and 2-2 th nodes n12 and n22 are the reference voltages Vref. In the initialization step Pi, the voltages at the 1-3 th, 1-4 th, 2-3 th, and 2-4 th nodes n13, n14, n23, and n24 and the voltages at the anode electrodes of the light emitting elements EL1 and EL2 are the initialization voltage Vinit.

Figure 7:
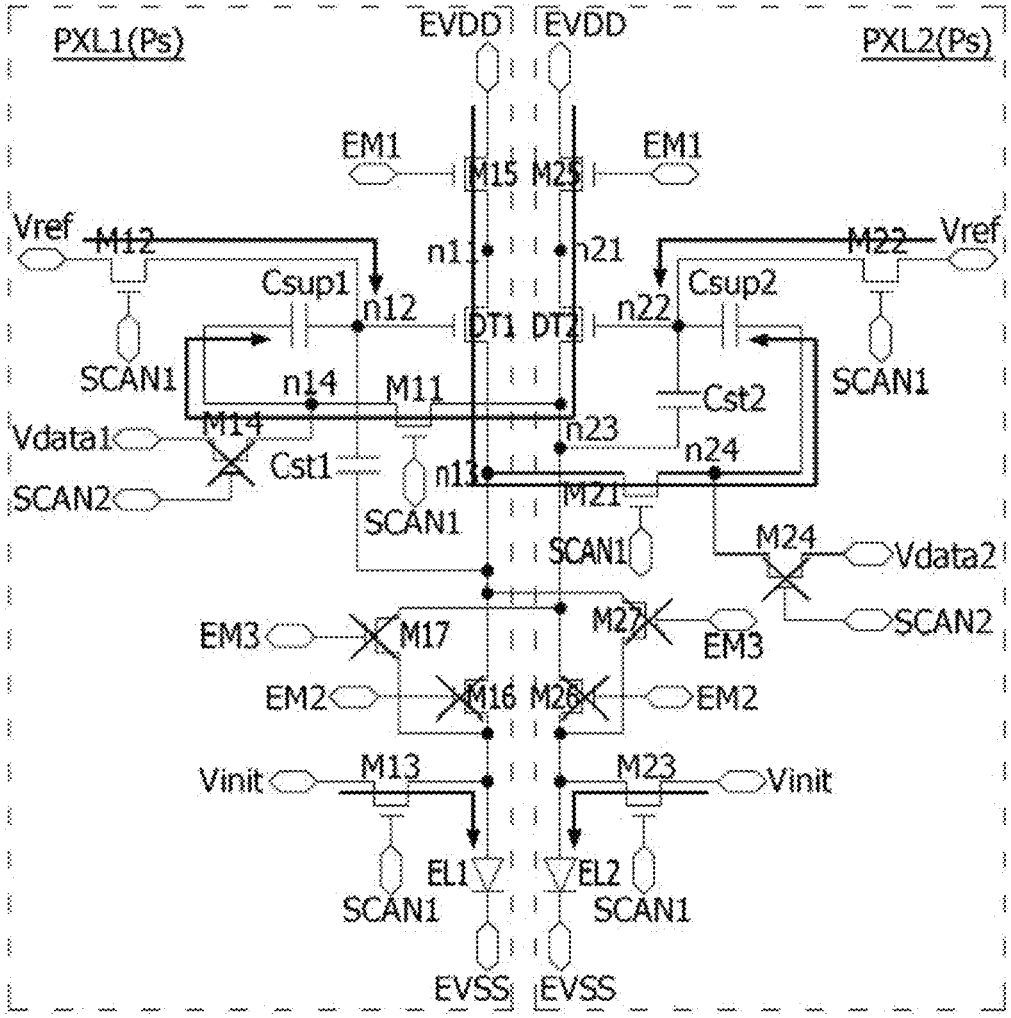
FIGS. 7 and 8 are diagrams illustrating a sensing step of the pixel circuit shown in FIG. 3.
Figure 8:
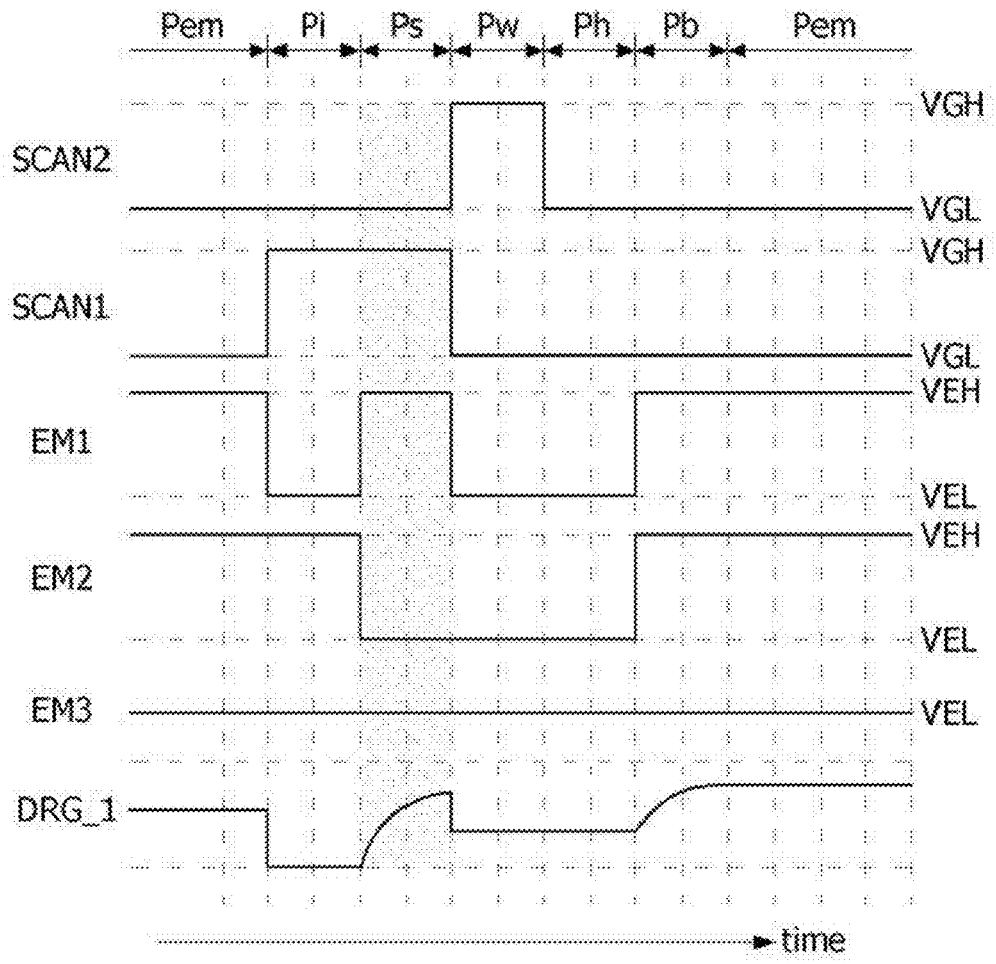

In the sensing step Ps, as shown in FIGS. 7 and 8, the 1-1 th, 1-2 th, 1-3 th, 1-5 th, 2-1 th, 2-2 th, 2-3 th, and 2-5 th switch elements M11, M12, M13, M15, M21, M22, M23, and M25 are turned on, and the other switch elements M14, M16, M17, M24, M26, and M27 are turned off. The driving elements DT1 and DT2 are turned off when the gate-source voltage Vgs reaches the threshold voltage Vth in the sensing step Ps. In the sensing step Ps, the threshold voltage Vth of the first driving element DT1 is sensed at the 1-3 th node n13, and this threshold voltage Vth is transmitted to the 2-2 th node n22 through the 2-1 th switch element M21, the 2-4 th node n24, and the 2-1 th capacitor Csup2. The threshold voltage Vth of the second driving element DT2 is sensed at the 2-3 th node n23, and this threshold voltage Vth is transmitted to the 1-2 th node n12 through the 1-1 th switch element M11, the 1-4 th node n14, and the 1-1 th capacitor Csup1. Accordingly, in the sensing step, the voltages at the 1-2 th and 2-2 th nodes n12 and n22 increase by the threshold voltages Vth of the driving elements DT1 and DT2.

Since the sensing step Ps can be set for two or more horizontal periods, the threshold voltage sensing time of the driving elements DT1 and DT2 may be sufficiently secured to effectively sense the threshold voltage in a high-resolution display panel in which one horizontal period becomes smaller. In addition, in the sensing step Ps, the threshold voltages Vth of the driving elements DT1 and DT2 may be transmitted to the gate electrodes of the driving elements DT1 and DT2, i.e., the 1-2 th and 2-2 th nodes n12 and n22 without lowering the sensing rate. Accordingly, the pixel circuit of the present disclosure may sense the threshold voltages Vth of the driving elements DT1 and DT2 by using the advantage of the pixel circuit of the source follower structure and the advantage of the pixel circuit of the diode connection structure.

Figure 9:
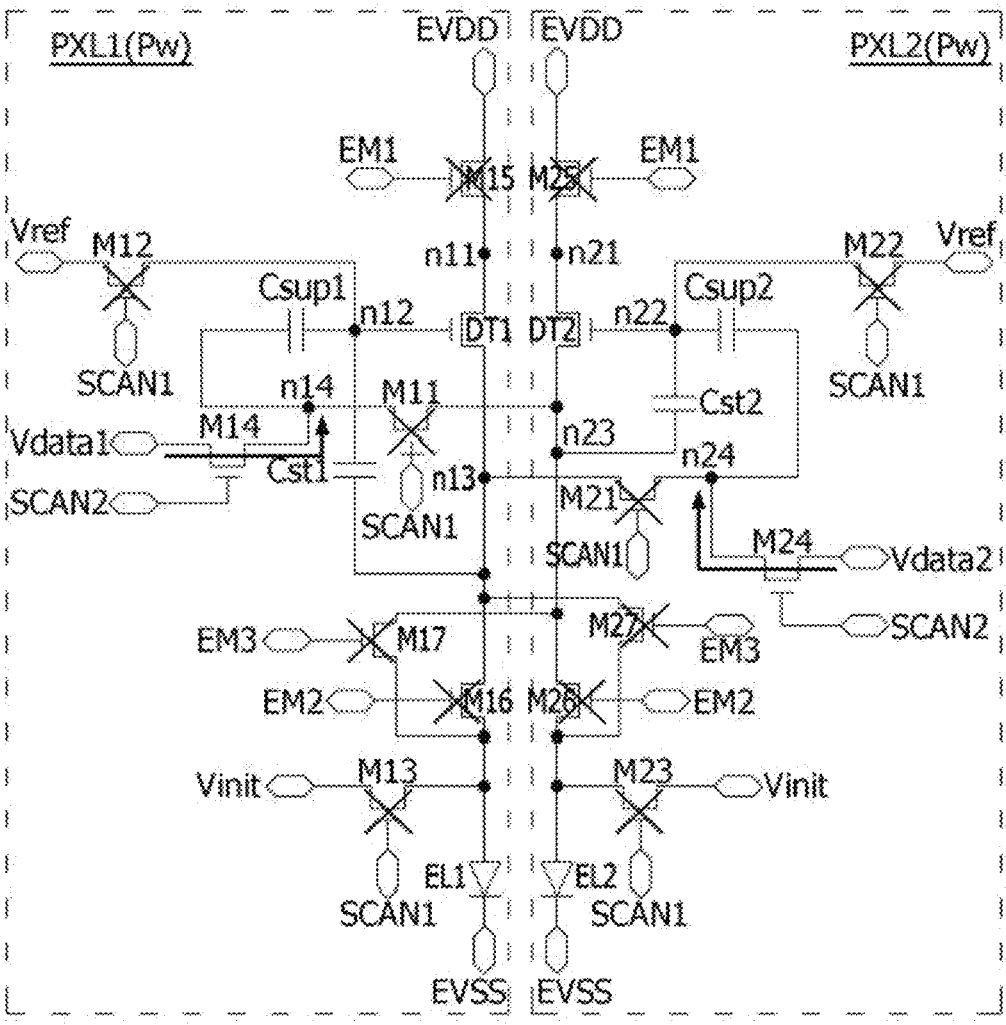
FIGS. 9 and 10 are diagrams illustrating a data writing step of the pixel circuit shown in FIG. 3.
Figure 10:
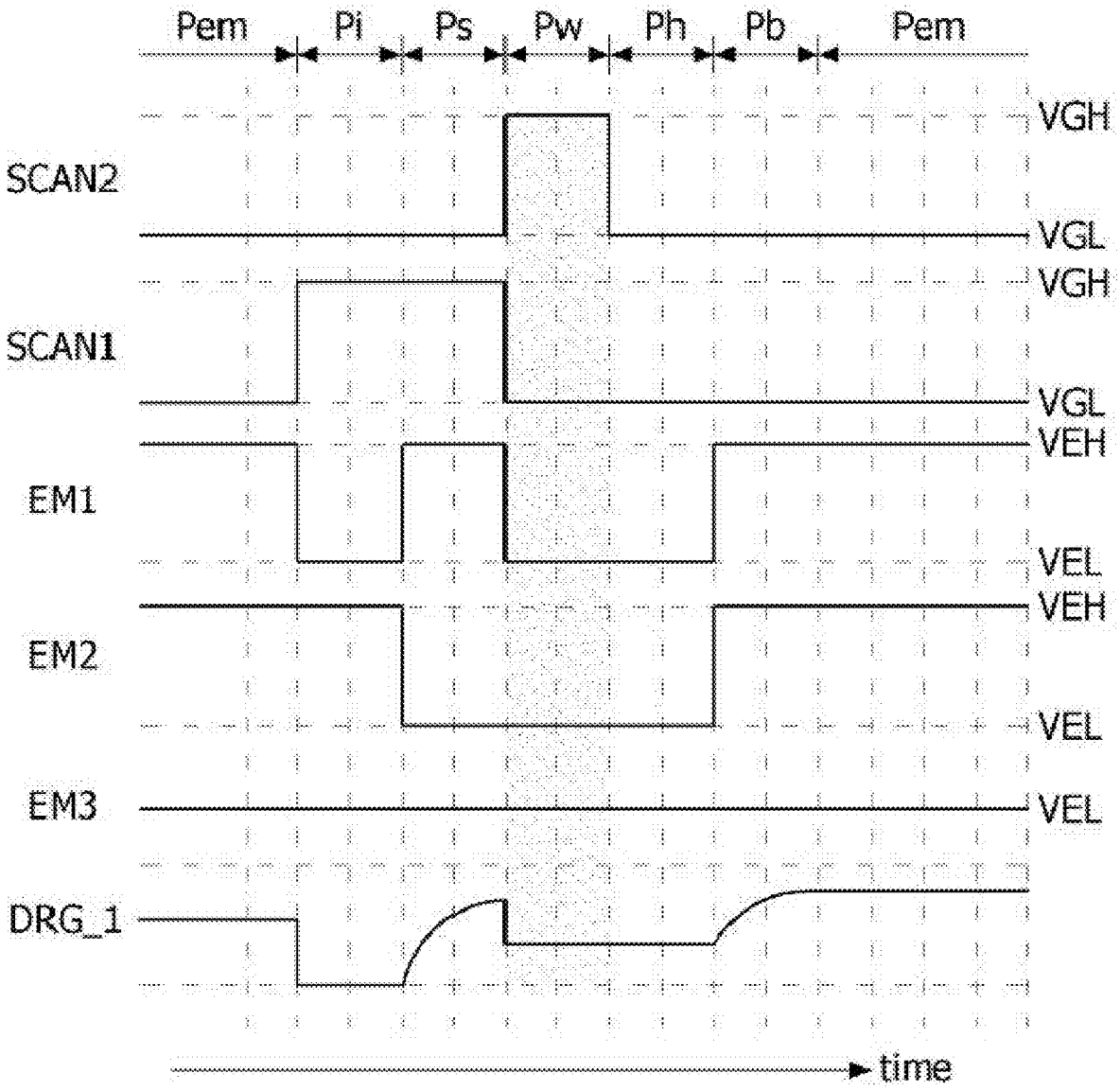

In the data writing step Pw, as shown in FIGS. 9 and 10, the 1-4 th and 2-4 th switch elements M14 and M24 are turned on, and the other switch elements M11 to M13, M15 to M17, M21 to M23, and M25 to M27 are turned off. In this case, the data voltage Vdata1 of the pixel data to be written into the first pixel PXL1 is applied to the 1-2 th node n12 through the 1-4 th switch element M14 and the 1-1 th capacitor Csup1. At the same time, the data voltage Vdata2 of the pixel data to be written into the second pixel PXL2 is applied to the 2-2 th node n22 through the 2-4 th switch element M24 and the 2-1 th capacitor Csup2.

In the data writing step Pw, the voltage of the 1-2 th node n12 is changed to the data voltage Vdata1, and the threshold voltage Vth is transmitted to the 1-4 th node n14 due to capacitor coupling through the 1-1 th capacitor Csup1. At the same time, the voltage of the 2-2 th node n22 is changed to the data voltage Vdata2, and the threshold voltage Vth is transmitted to the 2-4 th node n24 due to capacitor coupling through the 2-1 th capacitor Csup2. In this case, the voltages of the 1-3 th and 2-3 th nodes n13 and n23 may increase through the parasitic capacitance.

In the boosting step Pb, all the switch elements M11 to M17 and M21 to M27 are turned off. In this case, the capacitors of the light emitting elements EL1 and EL2 are charged to increase the anode voltage AND. In the boosting step Pb, the 1-2 th to 1-4 th nodes n12 to n14 and the 2-2 th to 2-4 th nodes n22 to n24 float, and the voltages DRG, DRG_1, and DRS at the nodes n12 to n14 and n22 to n24 increase.

Figure 11:
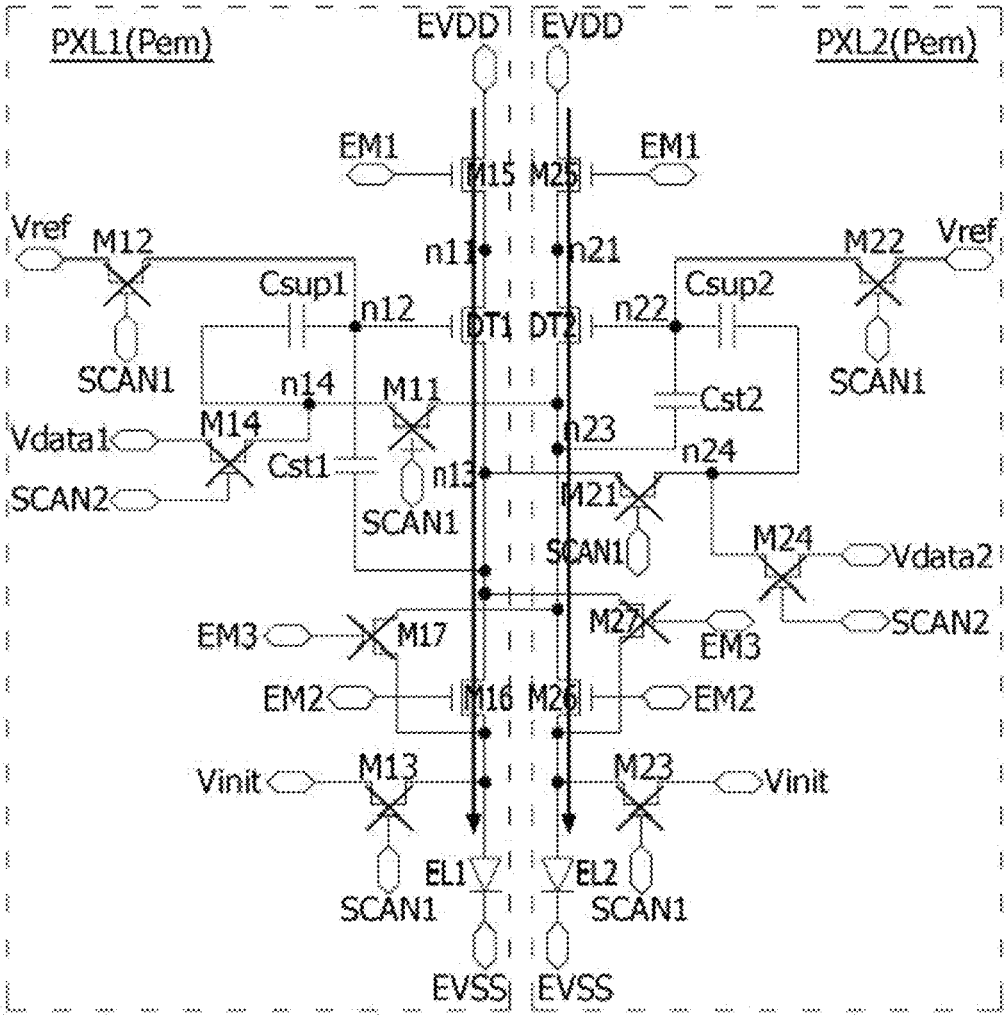
FIGS. 11 and 12 are diagrams illustrating an light emission step of the pixel circuit shown in FIG. 3.
Figure 12:
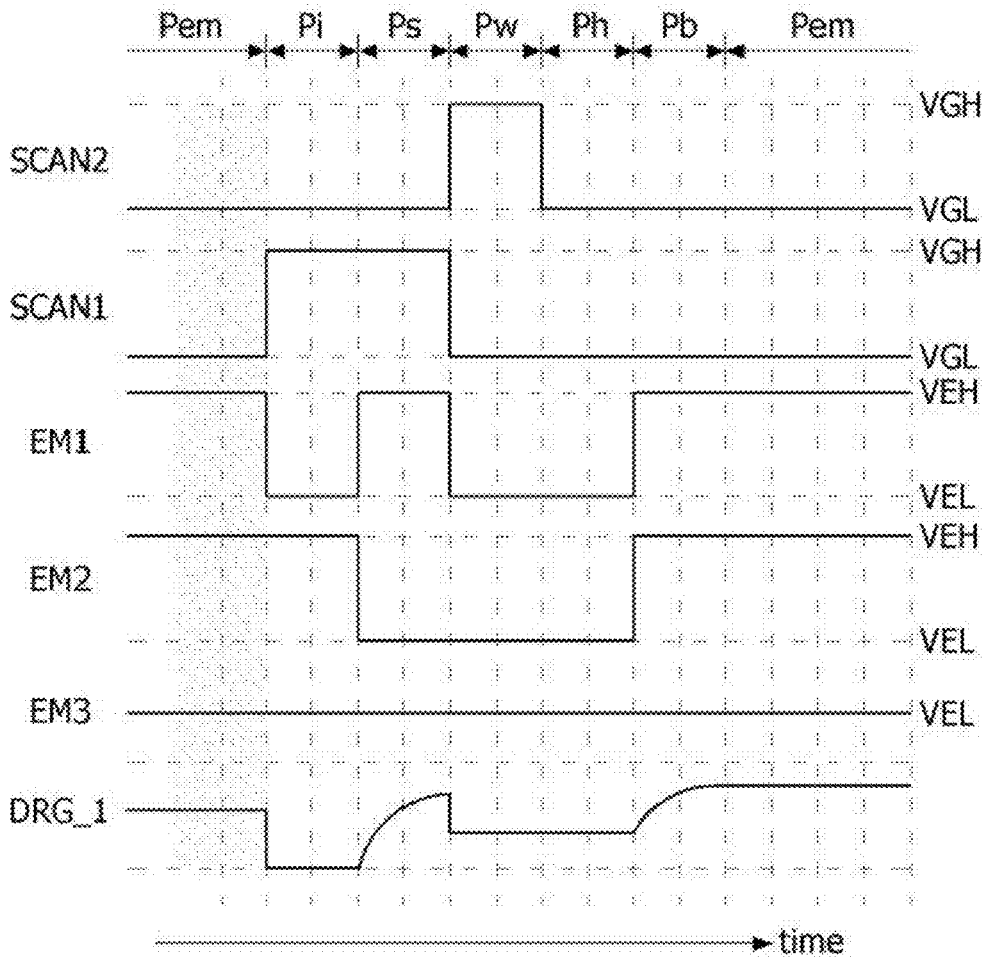

In the light emission step Pem, as shown in FIGS. 11 and 12, the 1-5 th, 1-6 th, 2-5 th, and 2-6 th switch elements M15, M16, M25, and M26 are turned on, and the other switch elements M11 to M14, M17, M21 to M24, and M27 are turned off. In this case, the first light emitting element EL1 may emit light by a current generated according to the gate-source voltage Vgs of the first driving element DT1. At the same time, the second light emitting element EL2 may emit light by a current generated according to the gate-source voltage Vgs of the second driving element DT2.

Figure 13:
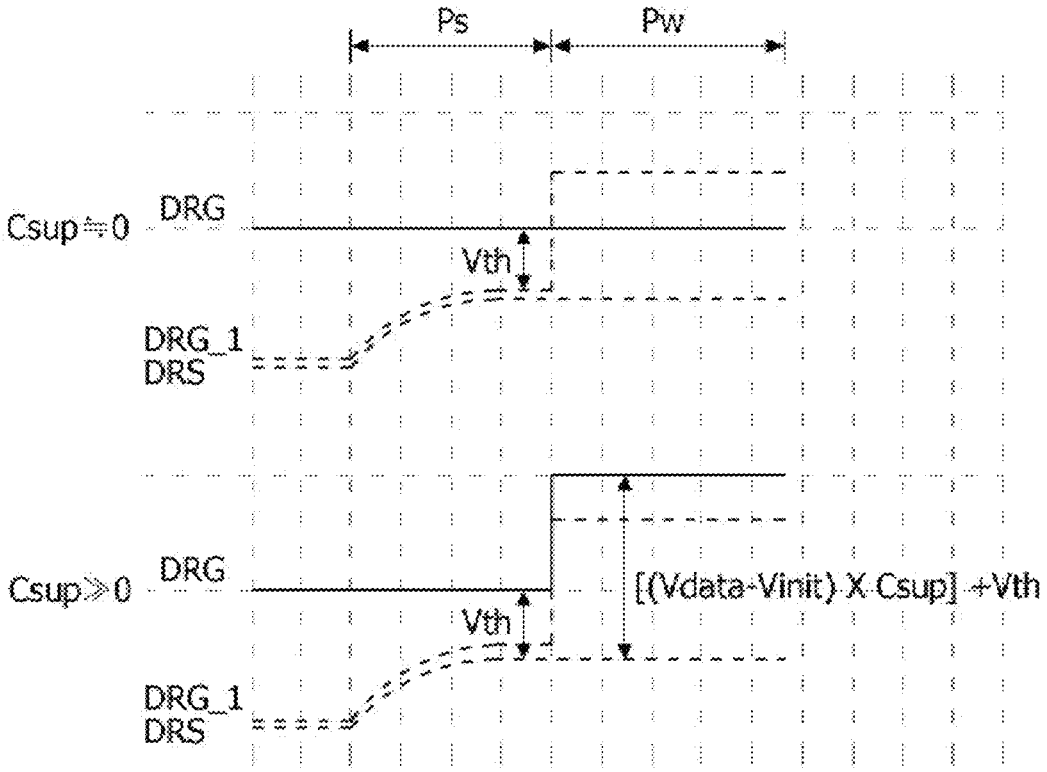
FIG. 13 is a diagram illustrating transmission rates of a data voltage and a threshold voltage of a driving element according to capacitances of first-first and second-first capacitors.

FIG. 13 is a diagram illustrating transmission rates of the data voltage Vdata and the threshold voltages Vth of the driving elements DT1 and DT2 according to capacitances of the 1-1 th and 2-1 th capacitors Csup1 and Csup2. As can be seen from FIG. 13, when the capacitances of the 1-1 th and 2-1 th capacitors Csup 1 and Csup2 are small (Csup≈0), the threshold voltages Vth of the driving elements DT1 and DT2 are hardly transmitted to the 1-2 th and 2-2 th nodes n12 and n22.

When the capacitances of the 1-1 th and 2-1 th capacitors Csup1 and Csup2 increase (Csup>>0), the transmission rate of the data voltage Vdata and the threshold voltages Vth of the driving elements DT1 and DT2 transmitted to the 1-2 th and 2-2 th nodes n12 and n22 increase. At the end of the data writing step Pw, the gate-source voltage Vgs of the driving elements DT1 and DT2 have a value of [(Vdata−Vinit) *Csup]+Vth. In the pixel circuit of the present disclosure, when the threshold voltages Vth of the driving elements DT1 and DT2 and the data voltage Vdata are transmitted to the gate electrodes of the driving elements DT1 and DT2 once through capacitor coupling, the voltage loss rate may be improved. The capacitances of the 1-1 th and 2-1 th capacitors Csup1 and Csup2 may be set to be the same as or different from those of the 1-2 th and 2-2 th capacitors Cst1 and Cst2.

Figure 14:
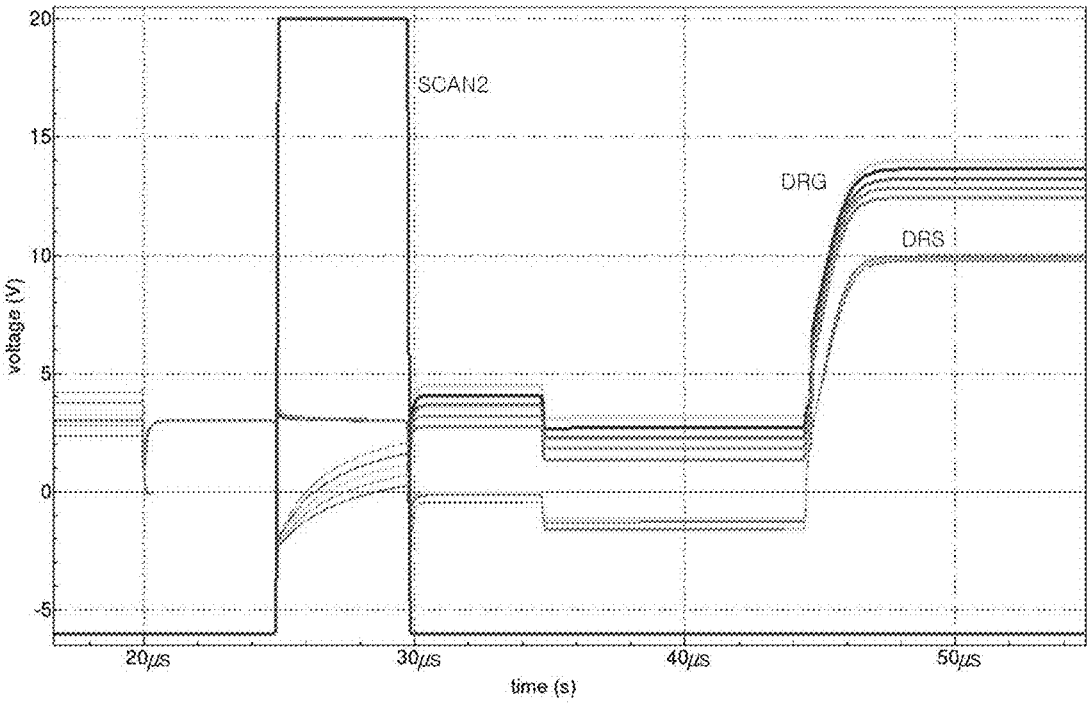
FIG. 14 is a diagram illustrating a simulation result of the pixel circuit according to the first embodiment of the present disclosure.

FIG. 14 is a diagram illustrating a simulation result of the pixel circuit according to the first embodiment of the present disclosure. As a result of this simulation, the present inventors found that the threshold voltages of the driving elements DT1 and DT2 can be sensed at a voltage greater than 0 V, as well as being sensed even when negatively shifted to a voltage less than 0 V.

The pixel circuit of the present disclosure may be driven only by the driving method shown in FIGS. 4 to 13 described above. In another embodiment, the data voltages Vdata1 and Vdata2 may be cross-applied between the pixels PXL1 and PXL2 in the pixel circuit of the present disclosure. For example, when an input image is inputted to the display device in a fixed pattern for a long time, the threshold voltage shift amounts of the driving elements DT1 and DT2 may vary between the pixels PXL1 and PXL2. In this case, the threshold voltage shift deviation of the driving elements between the pixels may be offset by cross-applying the data voltage Vdata to the pixels at a predetermined unit time period. Here, the unit time may be n (n being a positive integer) frame period or n seconds. This method may be applied to a still image in which a fixed pattern in the input image continues for a long time, or may be applied to any image regardless of whether the input image has a fixed pattern.

Figure 15:
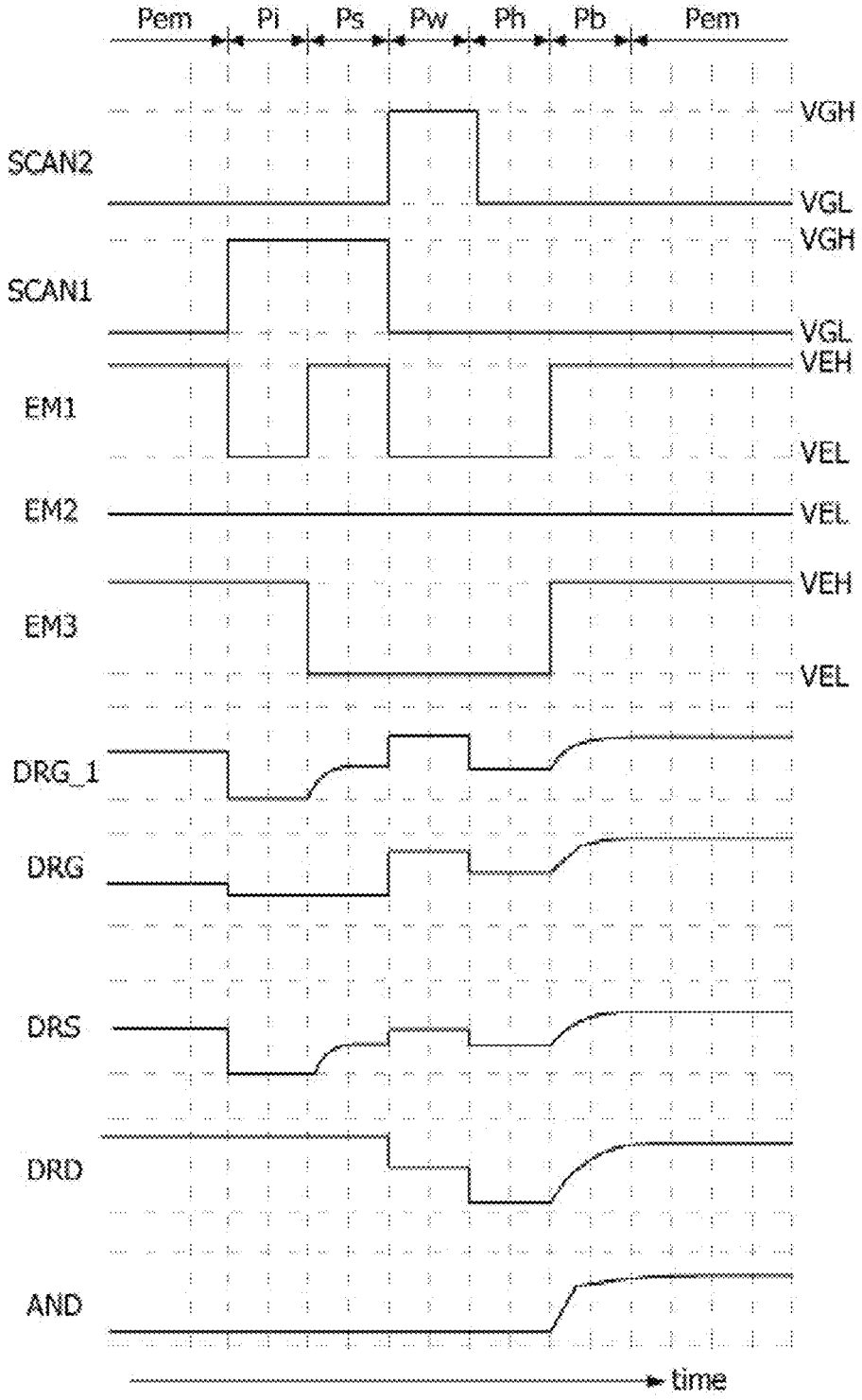
FIG. 15 is a waveform diagram illustrating a driving method in which a data voltage is cross-applied between adjacent pixels.

In the method of cross-applying the data voltage to the pixels, the pixel circuit may be driven in the same manner as in FIG. 4 for a first unit time (or first driving period) and then may be driven in the same manner as in FIG. 15 for a second unit time (or second driving period). Here, the first unit time may be interpreted as an odd-numbered unit time, and the second unit time may be interpreted as an even-numbered unit time. This driving method may not only offset the threshold voltage shift deviation of the driving elements DT1 and DT2 between the pixels PXL1 and PXL2, but also reduce deterioration of the driving elements DT1 and DT2. In addition, in this driving method, since the switch elements M16, M17, M26, and M27 to which the second and third EM pulses EM2 and EM3 are applied are alternately driven at a predetermined period of time, deterioration of the switch elements M16, M17, M26, and M27 may be reduced to improve reliability of the elements.

Figure 16:
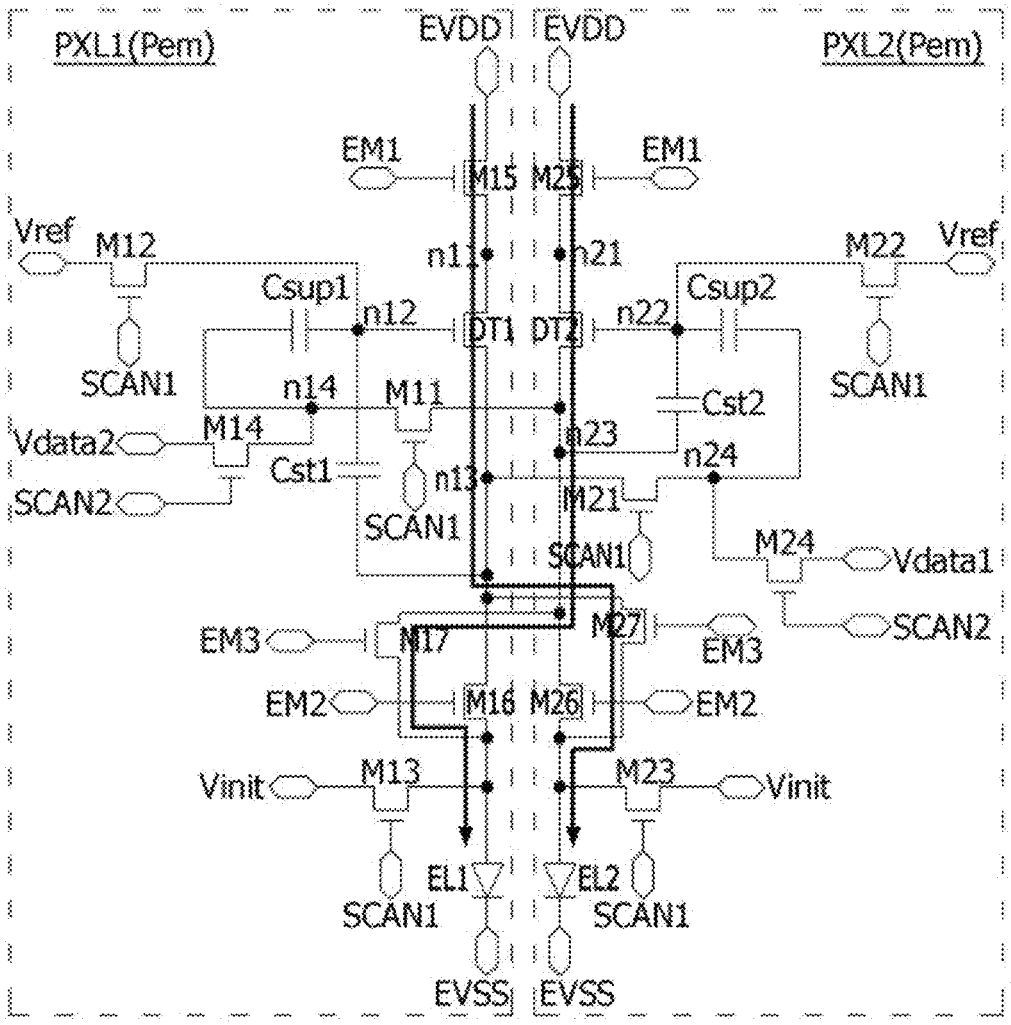
FIG. 16 is a circuit diagram illustrating an light emission step of the pixel circuit shown in FIG. 3 in the driving method of a pixel circuit shown in FIG. 15.

FIG. 15 is a waveform diagram illustrating a driving method in which a data voltage is cross-applied between adjacent pixels. FIG. 16 is a circuit diagram illustrating an light emission step of the pixel circuit shown in FIG. 3 in the method of driving the pixel circuit shown in FIG. 15. In this embodiment, a detailed description of components substantially the same as those of the first embodiment described above will be omitted.

Referring to FIGS. 15 and 16, the first pixel PXL1 includes the first light emitting element EL1, the first driving element DT1, the 1-1 th to 1-7 th switch elements M11 to M17, and the 1-1 th and 1-2 th capacitors Csup1 and Cst1. The second pixel PXL2 includes the second light emitting element EL2, the second driving element DT2, the 2-1 th to 2-7 th switch elements M21 to M27, and the 2-1 th and 2-2 th capacitors Csup2 and Cst2. The driving elements DT1 and DT2 and the switch elements M11 to M27 may be implemented with n-channel oxide TFTs.

The driving period of the pixel circuit may be divided into the initialization step Pi, the sensing step Ps, the data writing step Pw, the boosting step Pb, and the light emission step Pem as shown in FIG. 15. The hold step Ph may be set between the data writing step Pw and the boosting step Pb.

In the initialization step Pi, as shown in FIG. 15, the first scan pulse SCAN1 and the third EM pulse EM3 are generated at the gate-on voltages VGH and VEH. In the initialization step Pi, the second scan pulse SCAN2, the first EM pulse EM1, and the second EM pulse EM2 are at the gate-off voltages VGL and VEL.

In the sensing step Ps, as shown in FIG. 15, the first scan pulse SCAN1 and the first EM pulse EM1 are generated at the gate-on voltages VGH and VEH. The second scan pulse SCAN2, the second EM pulse EM2, and the third EM pulse EM3 are at the gate-off voltages VGL and VEL in the sensing step Ps.

In the data writing step Pw, as shown in FIG. 15, the second scan pulse SCAN2 is generated at the gate-on voltage VGH synchronized with the data voltages Vdata1 and Vdata2 of the pixel data. The gate pulses SCAN1, EM1, EM2, and EM3 other than the second scan pulse SCAN2 are generated at the gate-off voltages VGL and VEL in the data writing step Pw.

In the hold step Ph, all the gate pulses SCAN1, SCAN2, EM1, EM2, and EM3 are at the gate-off voltages VGL and VEL. At this time, the main nodes n11 to n14 and n21 to n24 of the pixel circuit are floated to maintain their voltages.

In the boosting step Pb and the light emission step Pem, as shown in FIG. 15, the first and third EM pulses EM1 and EM3 are at the gate-on voltage VEH, while the first and second scan pulses SCAN1 and SCAN2 and the second EM pulse EM2 are at the gate-off voltage VGL.

During the first unit time, as shown in FIG. 3, the data voltage Vdata1 of first pixel data to be written into the first pixel PXL1 is applied to the 1-4 th switch element M14 of the first pixel PXL1. At the same time, the data voltage Vdata2 of second pixel data to be written into the second pixel PXL2 is applied to the 2-4 th switch element M24 of the second pixel PXL2.

During the second unit time, as shown in FIG. 16, the data voltage Vdata1 of the first pixel data to be written into the first pixel PXL1 is applied to the 2-4 th switch element M24 of the second pixel PXL2. At the same time, the data voltage Vdata2 of the second pixel data to be written into the second pixel PXL2 is applied to the 1-4 th switch element M14 of the first pixel PXL1.

As shown in FIGS. 3 and 4, the 1-4 th switch element M14 is turned on in response to the gate-on voltage VGH of the second scan pulse SCAN2 synchronized with the data voltage Vdata1 of the first pixel data in the data writing step Pw of the first unit time to supply the data voltage Vdata1 to the 1-4 th node n14. As shown in FIGS. 15 and 16, the 1-4 th switch element M14 is turned on in response to the gate-on voltage VGH of the second scan pulse SCAN2 synchronized with the data voltage Vdata2 of the second pixel data in the data writing step Pw of the second unit time to supply the data voltage Vdata2 to the 1-4 th node n14.

As shown in FIGS. 3 and 4, the 2-4 th switch element M24 is turned on in response to the gate-on voltage VGH of the second scan pulse SCAN2 synchronized with the data voltage Vdata2 of the second pixel data in the data writing step Pw of the first unit time to supply the data voltage Vdata2 to the 2-4 th node n24. As shown in FIGS. 15 and 16, the 2-4 th switch element M24 is turned on in response to the gate-on voltage VGH of the second scan pulse SCAN2 synchronized with the data voltage Vdata1 of the first pixel data in the data writing step Pw of the second unit time to supply the data voltage Vdata1 to the 2-4 th node n24.

As shown in FIGS. 3 and 4, the 1-6 th and 2-6 th switch elements M16 and M26 are turned on in response to the gate-on voltage VEH of the second EM pulse EM2 in the initialization step Pi, the boosting step Pb, and the light emission step Pem of the first unit time. At this time, as shown in FIG. 11, a current from the first driving element DT1 flows to the first light emitting element EL1 through the 1-7 th switch element M17, and a current from the second driving element DT2 flows to the second light emitting element EL2 through the 2-7 th switch element M27. As shown in FIGS. 15 and 16, the 1-6 th and 2-6 th switch elements M16 and M26 are not driven since they remain in an off state according to the second EM pulse EM2 that maintains the gate-off voltage VEL for the second unit time.

As shown in FIGS. 3 and 4, the 1-7 th and 2-7 th switch elements M17 and M27 are not driven since they remain in an off state according to the third EM pulse EM3 that maintains the gate-off voltage VEL for the first unit time. As shown in FIGS. 15 and 16, the 1-7 th and 2-7 th switch elements M17 and M27 are turned on in response to the gate-on voltage VEH of the third EM pulse EM3 in the initialization step Pi, the boosting step Pb, and the light emission step Pem of the second unit time. At this time, as shown in FIG. 16, a current from the first driving element DT1 flows to the second light emitting element EL2 through the 2-7 th switch element M27, and a current from the second driving element DT2 flows to the first light emitting element EL1 through the 1-7 th switch element M17.

The capacitors Csup1, Cst1, Csup2, and Cst2 are not limited to those in the embodiments described above. The capacitors Csup1, Cst1, Csup2, and Cst2 may be connected to the pixel circuit as shown in FIGS. 17A and 17B.

Referring to FIG. 17A, the 1-1 th capacitor Csup1 is connected between the 1-2 th node n12 and the 1-4 th node n14, and the 2-1 th capacitor Csup2 is connected between the 2-2 th node n22 and the 2-4 th node n24. The 1-2 th capacitor Cst1 may be connected between the 1-4 th node n14 and the 1-3 th node n13, and the 2-2 th capacitor Cst2 may be connected between the 2-4 th node n24 and the 2-3 th node n23.

Referring to FIG. 17B, the capacitors Csup1, Cst1, Csup2, and Cst2 may be connected in the same connection structure as in the above-described embodiments. That is, the 1-1 th capacitor Csup1 is connected between the 1-2 th node n12 and the 1-4 th node n14, and the 2-1 th capacitor Csup2 is connected between the 2-2 th node n22 and the 2-4 th node n24. The 1-2 th capacitor Cst1 may be connected between the 1-2 th node n12 and the 1-3 th node n13, and the 2-2 th capacitor Cst2 may be connected between the 2-2 th node n22 and the 2-3 th node n23.

Figure 18:
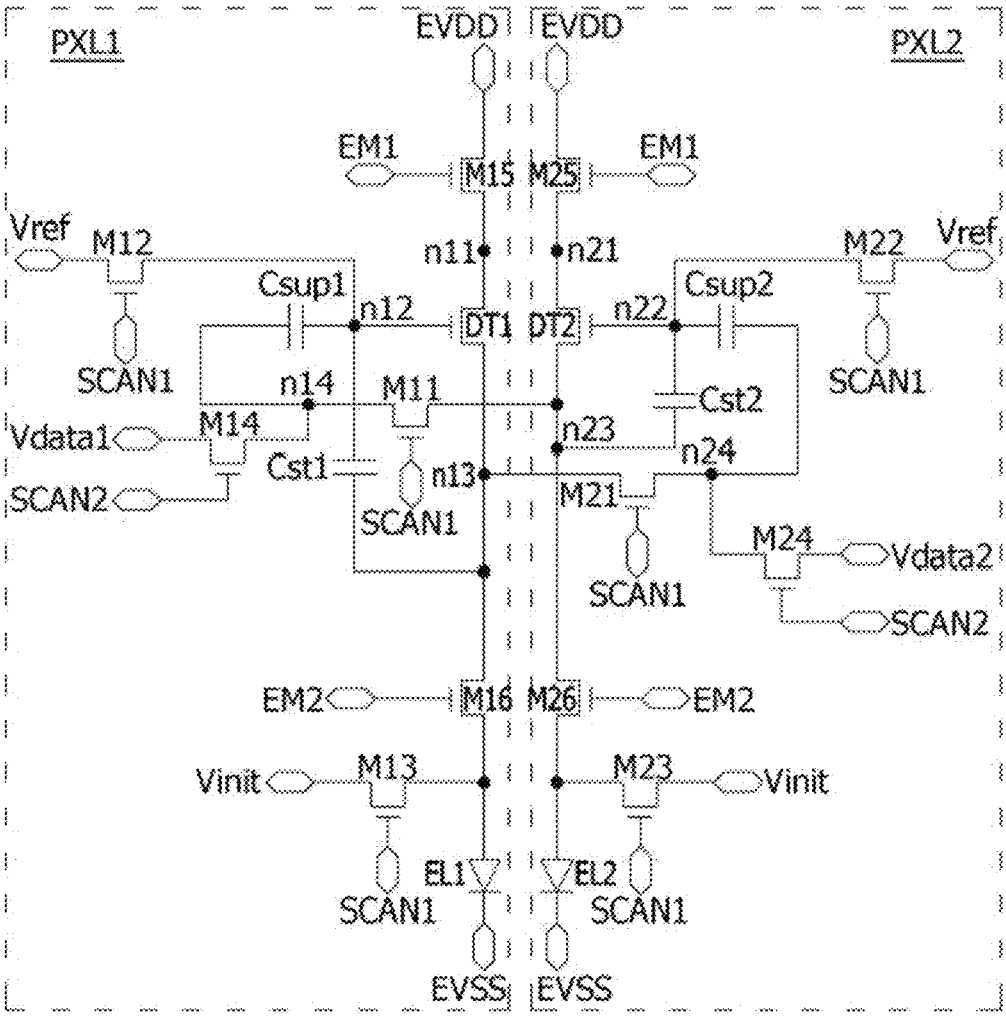
FIG. 18 is a circuit diagram illustrating a pixel circuit of adjacent pixels according to a second embodiment of the present disclosure.
Figure 19:
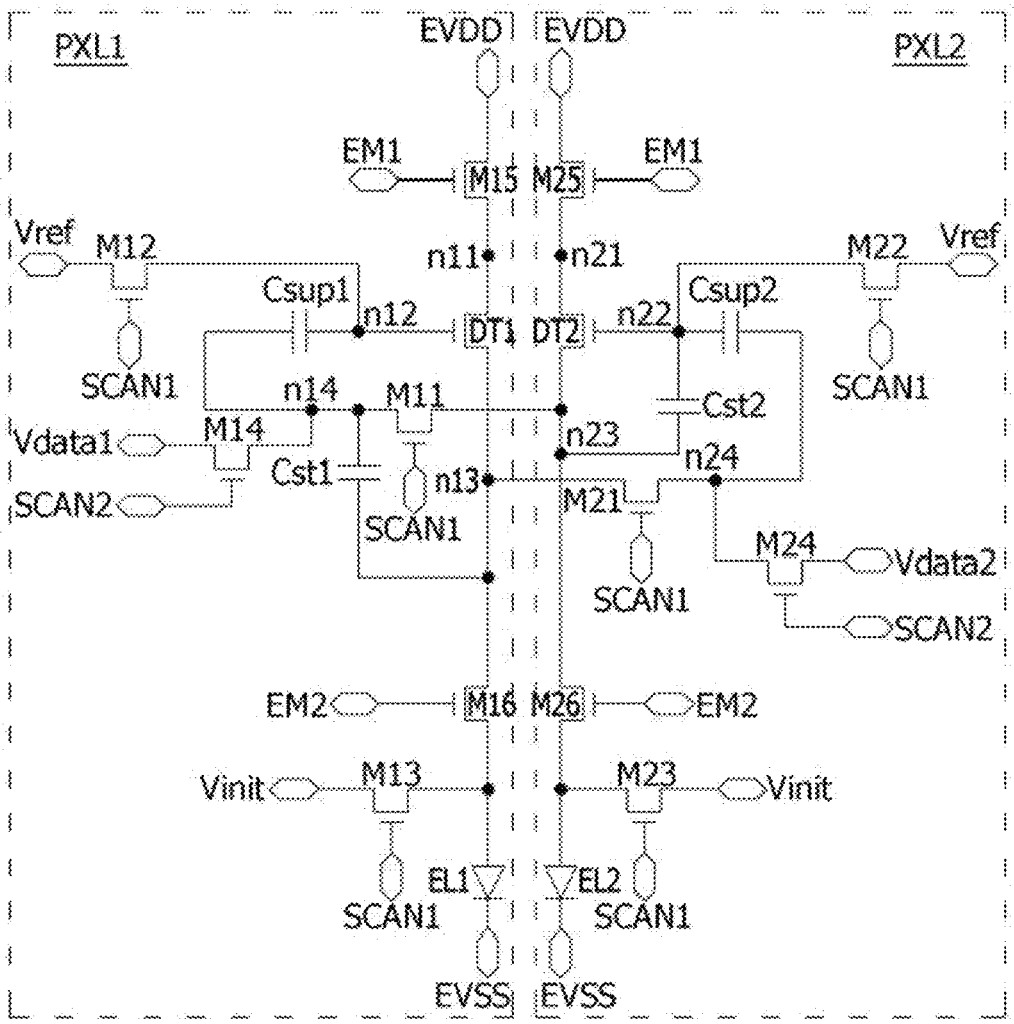
FIG. 19 is a circuit diagram illustrating a pixel circuit of adjacent pixels according to a third embodiment of the present disclosure.

FIG. 18 is a circuit diagram illustrating a pixel circuit of adjacent pixels according to a second embodiment of the present disclosure. FIG. 19 is a circuit diagram illustrating a pixel circuit of adjacent pixels according to a third embodiment of the present disclosure. The data voltages Vdata1 and Vdata2 and the gate pulses SCAN1, SCAN2, EM1, and EM2 as shown in FIG. 4 are applied to the pixel circuits of the present embodiments. In these embodiments, the 1-2 th and 2-2 th nodes n12 and n22 are initialized to the reference voltage Vref applied to the 1-2 th and 2-2 th switch elements M12 and M22.

Figure 20:
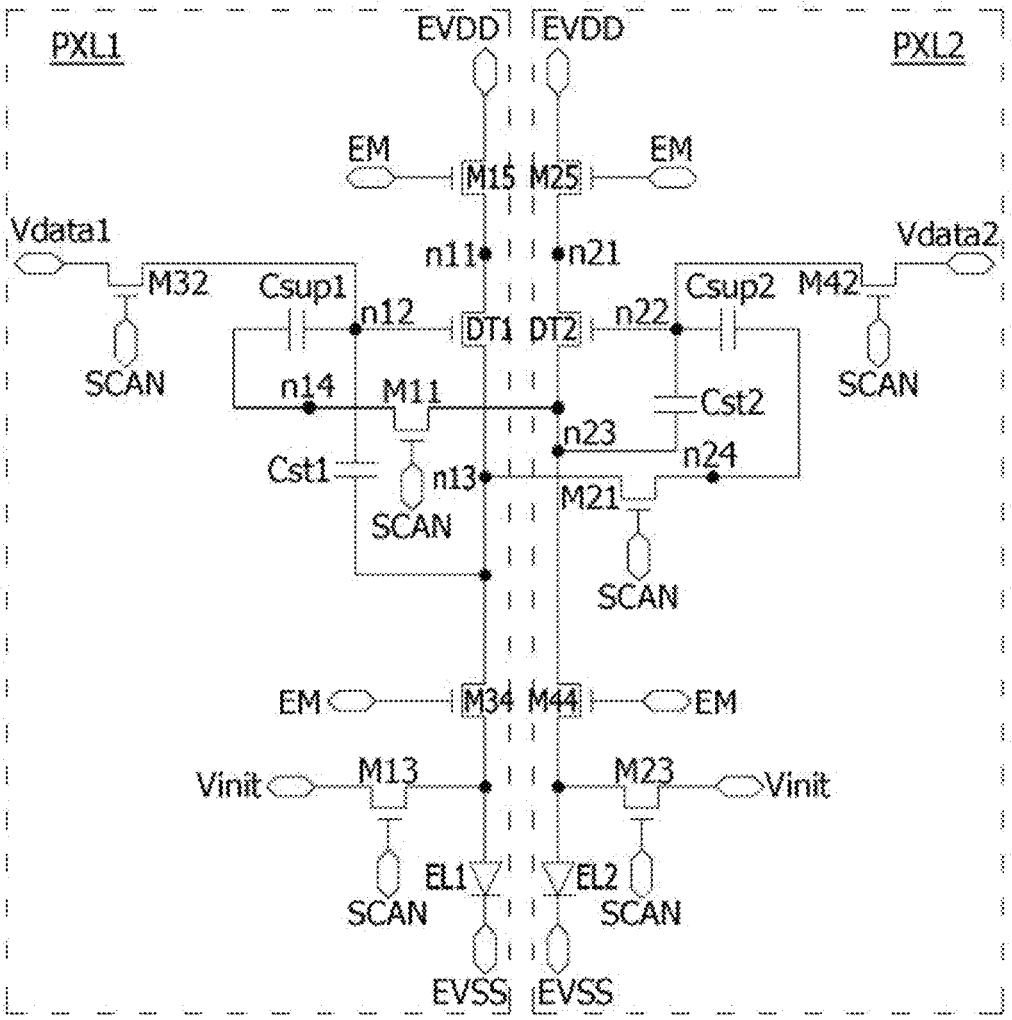
FIG. 20 is a circuit diagram illustrating a pixel circuit of adjacent pixels according to a fourth embodiment of the present disclosure.
Figure 21:
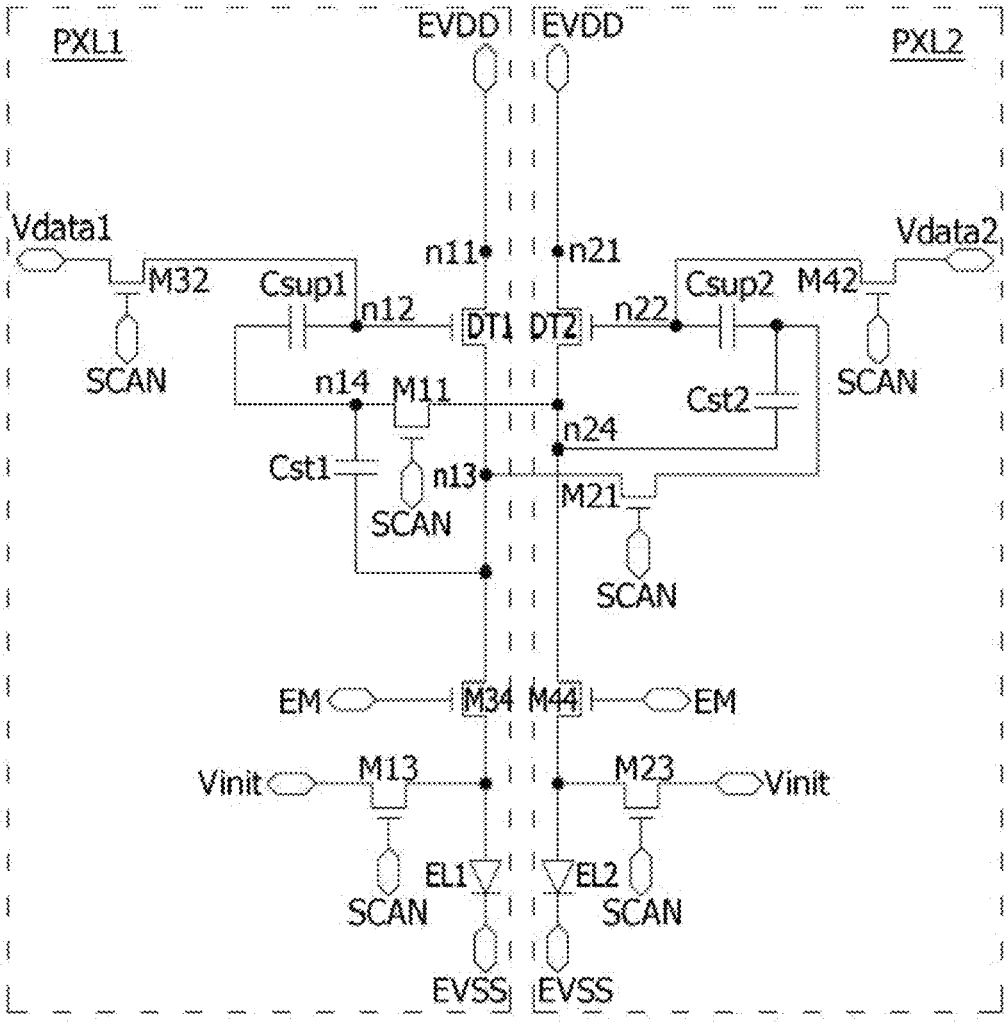
FIG. 21 is a circuit diagram illustrating a pixel circuit of adjacent pixels according to a fifth embodiment of the present disclosure.
Figure 22:
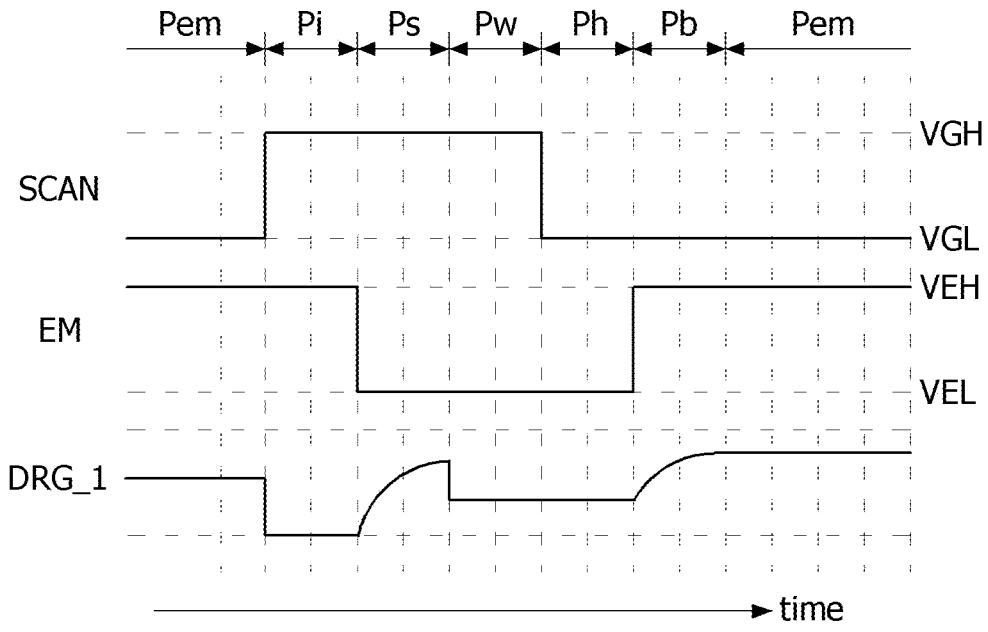
FIG. 22 is a waveform diagram illustrating a gate pulse applied to the pixel circuits shown in FIGS. 20 and 21.

FIG. 20 is a circuit diagram illustrating a pixel circuit of adjacent pixels according to a fourth embodiment of the present disclosure. FIG. 21 is a circuit diagram illustrating a pixel circuit of adjacent pixels according to a fifth embodiment of the present disclosure. In these embodiments, each of the pixels PXL1 and PXL2 may be implemented with a pixel circuit including five transistors and two capacitors. FIG. 22 is a waveform diagram illustrating a gate pulse applied to the pixel circuits shown in FIGS. 20 and 21. In these embodiments, the 1-2 th and 2-2 th nodes n12 and n22 are initialized to the data voltages Vdata1 and Vdata2 applied to 1-2 th and 2-2 th switch elements M32 and M42.

Referring to FIGS. 20, 21, and 22, the first pixel PXL1 includes a first light emitting element EL1, a first driving element DT1, 1-1th to 1-4 th switch elements M11, M32, M13, and M34, and 1-1 th and 1-2 th capacitors Csup1 and Cst1. The second pixel PXL2 includes a second light emitting element EL2, a second driving element DT2, 2-1 th to 2-4 th switch elements M21, M42, M23, and M44, and 2-1 th and 2-2 th capacitors Csup2 and Cst2. The driving elements DT1 and DT2 and the switch elements M11, M32, M13, M34, M21, M42, M23, and M44 may be implemented with n-channel oxide TFTs.

The first and second pixels PXL1 and PXL2 share power lines through which constant voltages EVDD, EVSS, and Vinit are applied, and share gate lines through which gate pulses SCAN1, SCAN2, and EM are applied. The first and second pixels PXL1 and PXL2 are connected to different data lines. The first pixel PXL1 may be connected to a first data line through which a first data voltage Vdata1 is applied. The second pixel PXL2 may be connected to a second data line through which a second data voltage Vdata2 is applied.

The power lines may include a VDD line through which a pixel driving voltage EVDD is applied, a VSS line through which a pixel reference voltage EVSS is applied, an INIT line through which an initialization voltage Vinit is applied, and the like. The pixel driving voltage EVDD is higher than the maximum voltage of the data voltages Vdata1 and Vdata2. The pixel reference voltage EVSS and the initialization voltage Vinit are lower than the minimum voltage of the data voltages Vdata1 and Vdata2. The pixel reference voltage EVSS and the initialization voltage Vinit may be set to the same voltage or to different voltages.

The gate pulses SCAN and EM swing between the gate-on voltage VGH, VEH and the gate-off voltage VGL, VEL. The gate-on voltages VGH and VEH may be set to be higher than the pixel driving voltage EVDD. The gate-off voltages VGL and VEL may be set to be lower than the pixel reference voltage EVSS. The gate pulses SCAN and EM include a scan pulse SCAN applied to a first gate line and an EM pulse EM applied to a second gate line. The gate driver of the display device may include a first shift register generating the scan pulse SCAN and a second shift register generating the EM pulse.

The driving period of the pixel circuit may, as shown in FIG. 22, be divided into an initialization step Pi, a sensing step Ps, a data writing step Pw, a boosting step Pb, and an light emission step Pem. A hold step Ph may be set between the data writing step Pw and the boosting step Pb.

In the initialization step Pi, the scan pulse SCAN and the EM pulse EM are generated at the gate-on voltages VGH and VEH. In the sensing step Ps, the scan pulse SCAN is generated at the gate-on voltage VGH, and the EM pulse EM is inverted to the gate-off voltage VEL.

In the data writing step Pw, the scan pulse SCAN is generated at the gate-on voltage VGH synchronized with the data voltages Vdata1 and Vdata2 of the pixel data, and the EM pulse EM is at the gate-off voltage VEL.

In the hold step Ph, the scan pulse SCAN and the EM pulse EM are at the gate-off voltages VGL and VEL. In the boosting step Pb and the light emission step Pem, the EM pulse EM is at the gate-on voltage VEH, while the scan pulse SCAN is at the gate-off voltage VGL.

The light emitting elements EL1 and EL2 may be implemented with OLEDs. The anode electrode of the first light emitting element EL1 is connected to the first driving element DT1 with the 1-4 th switch elements M34 interposed therebetween. The anode electrode of the second light emitting element EL2 is connected to the second driving element DT2 with the 2-4 th switch element M44 interposed therebetween. When the switch elements M34 and M44 are turned on, the anode electrodes of the light emitting elements EL1 and EL2 are connected to the driving elements DT1 and DT2, so that the light emitting elements EL1 and EL2 may emit light by a current from the driving elements DT1 and DT2. The cathode electrodes of the light emitting elements EL1 and EL2 are connected to the VSS line through which the pixel reference voltage EVSS is applied. Each of the light emitting elements EL1 and EL2 include a capacitor Cel1 connected between the anode electrode and the cathode electrode.

In the first pixel PXL1, the first driving element DT1 generates a current according to the gate-source voltage Vgs to drive the first light emitting element EL1. The first driving element DT1 includes a first electrode connected to the 1-1 th node n11, a gate electrode connected to the 1-2 th node n12, and a second electrode connected to the 1-3 th node n13.

The 1-1 th capacitor Csup1 is connected between the 1-2 th node n12 and the 1-4 th node n14. The 1-2 th capacitor Cst1 may, as shown in FIG. 20, be connected between the 1-2 th node n12 and the 1-3 th node n13, or as shown in FIG. 21, be connected between the 1-4 th node n14 and the 1-3 th node n13. The 2-1 th capacitor Csup2 is connected between the 2-2 th node n22 and the 2-4 th node n24. The 2-2 th capacitor Cst2 may, as shown in FIG. 20, be connected between the 2-2 th node n22 and the 2-3 th node n23, or as shown in FIG. 21, be connected between the 2-4 th node n24 and the 2-3 th node n23.

The 1-1 th switch element M11 is turned on in response to the gate-on voltage VGH of the scan pulse SCAN in the initialization step Pi, the sensing step Ps, and the data writing step Pw to connect the 1-4 th node n14 to the 2-3 th node n23 of the second pixel PXL2. The 1-1 th switch element M11 includes a gate electrode connected to the first gate line through which the scan pulse SCAN is applied, a first electrode connected to the 1-4 th node n14, and a second electrode connected to the 2-3 th node n23.

The 1-2 th switch element M32 is turned on in response to the gate-on voltage VGH of the scan pulse SCAN in the initialization step Pi, the sensing step Ps, and the data writing step Pw to supply the first data voltage Vdata1 to the 1-2 th node n12. The 1-2 th switch element M12 includes a gate electrode connected to the first gate line through which the scan pulse SCAN is applied, a first electrode connected to the first data line through which the first data voltage Vdata1 is applied, and a second electrode connected to 1-2 th node n12.

The 1-3 th switch elements M13 are turned on in response to the gate-on voltage VGH of the scan pulse SCAN in the initialization step Pi, the sensing step Ps, and the data writing step Pw to supply the initialization voltage Vinit to the anode electrode of the first light emitting element EL1. The 1-3 th switch element M13 includes a gate electrode connected to the first gate line through which the scan pulse SCAN is applied, a first electrode connected to the INIT line through which the initialization voltage Vinit is applied, and a second electrode connected to the anode electrode of the first light emitting element EL1.

The 1-4 th switch element M34 is turned on in response to the gate-on voltage VEH of the EM pulse EM in the initialization step Pi, the boosting step Pb, and the light emission step Pem to connect the 1-3 th node n13 to the anode electrode of the first light emitting element EL1. The 1-4 th switch element M34 includes a gate electrode connected to the second gate line through which the EM pulse EM is applied, a first electrode connected to the 1-3 th node n13, and a second electrode connected to the anode electrode of the first light emitting element EL1.

In the second pixel PXL2, the second driving element DT2 generates a current according to the gate-source voltage Vgs to drive the second light emitting element EL2. The second driving element DT2 includes a first electrode connected to the 2-1 th node n21, a gate electrode connected to the 2-2 th node n22, and a second electrode connected to the 2-3 th node n23.

The 2-1 th switch element M21 is turned on in response to the gate-on voltage VGH of the scan pulse SCAN in the initialization step Pi, the sensing step Ps, and the data writing step Pw to connect the 2-4 th node n24 to the 1-3 th node n13 of the first pixel PXL1. The 2-1 th switch element M21 includes a gate electrode connected to the first gate line through which the scan pulse SCAN is applied, a first electrode connected to the 2-4 th node n24, and a second electrode connected to the 1-3 th node n13.

The 2-2 th switch element M42 is turned on in response to the gate-on voltage VGH of the scan pulse SCAN in the initialization step Pi, the sensing step Ps, and the data writing step Pw to supply the second data voltage Vdata2 to the 2-2 th node n22. The 2-2 th switch element M42 includes a gate electrode connected to the first gate line through which the scan pulse SCAN is applied, a first electrode connected to the second data line through which the second data voltage Vdata2 is applied, and a second electrode connected to the 2-2 th node n22.

The 2-3 th switch element M23 is turned on in response to the gate-on voltage VGH of the scan pulse SCAN in the initialization step Pi, the sensing step Ps, and the data writing step Pw to supply the initialization voltage Vinit to the anode electrode of the second light emitting element EL2. The 2-3 th switch element M23 includes a gate electrode connected to the first gate line through which the scan pulse SCAN is applied, a first electrode connected to the INIT line through which the initialization voltage Vinit is applied, and a second electrode connected to the anode electrode of the second light emitting element EL2.

The 2-4 th switch element M44 is turned on in response to the gate-on voltage VEH of the EM pulse EM in the initialization step Pi, the boosting step Pb, and the light emission step Pem to connect the 2-3 th node n23 to the anode electrode of the second light emitting element EL2. The 2-4 th switch element M44 includes a gate electrode connected to the second gate line through which the EM pulse EM is applied, a first electrode connected to the 2-3 th node n23, and a second electrode connected to the anode electrode of the second light emitting element EL2.

Figure 23:
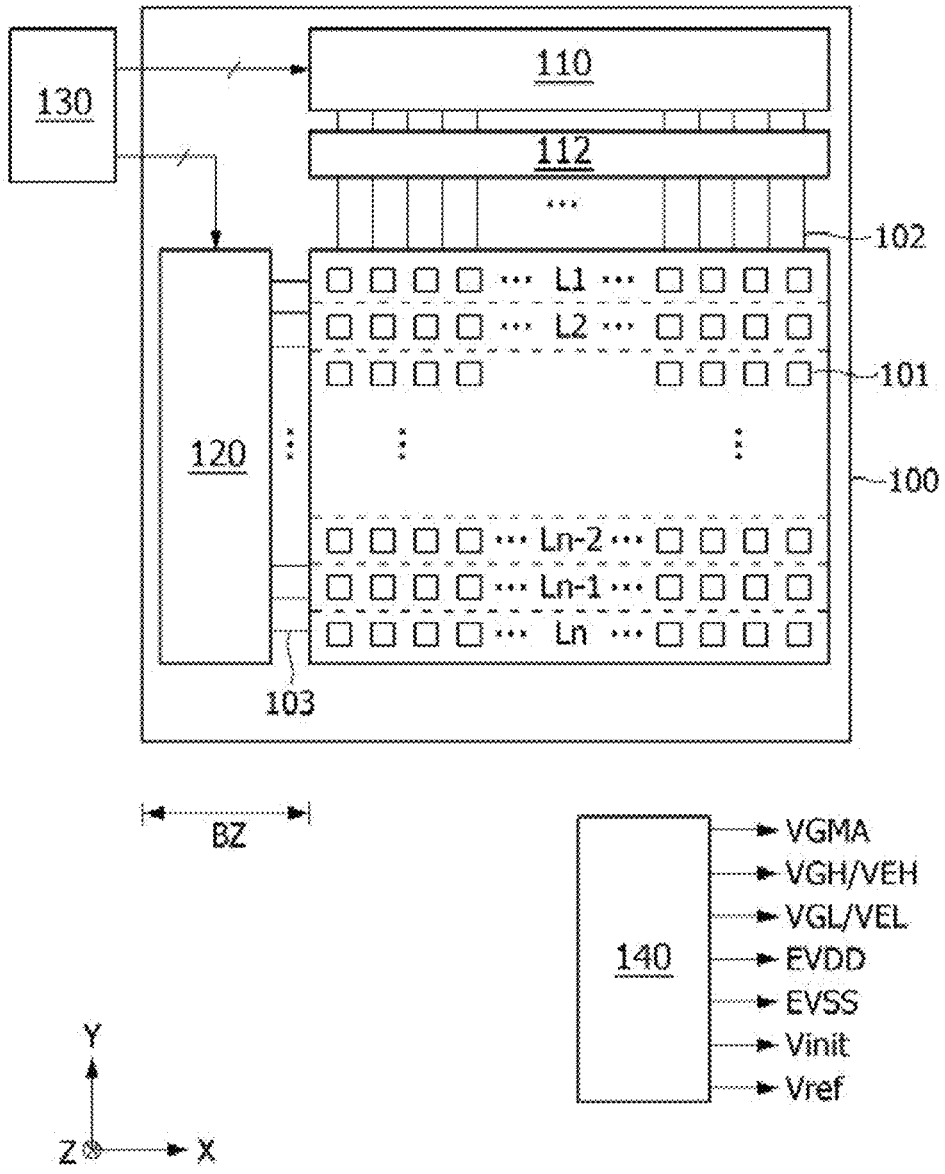
FIG. 23 is a block diagram illustrating a display device according to an embodiment of the present disclosure.
Figure 24:
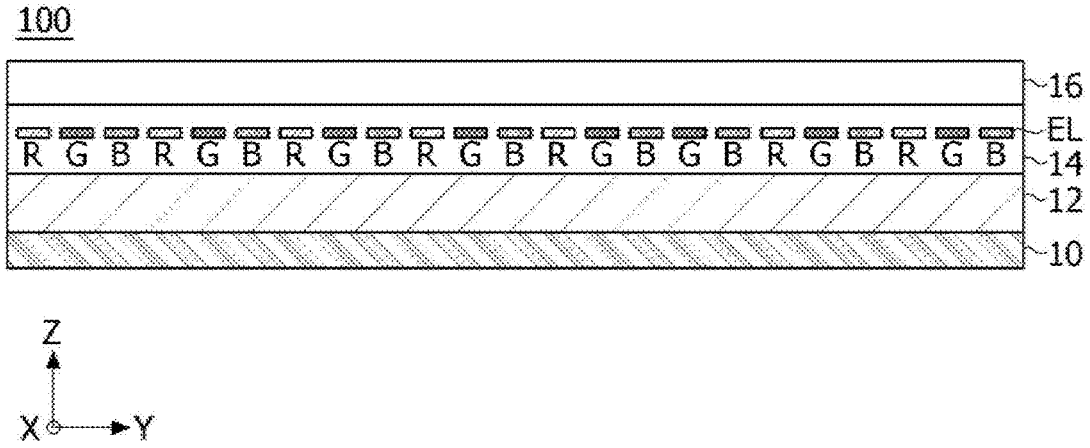
FIG. 24 is a cross-sectional view illustrating a cross-sectional structure of a display panel shown in FIG. 23.

FIG. 23 is a block diagram illustrating a display device according to an embodiment of the present disclosure. FIG. 24 is a cross-sectional view illustrating a cross-sectional structure of a display panel shown in FIG. 23.

Referring to FIGS. 23 and 24, a display device according to an embodiment of the present disclosure includes a display panel 100, a display panel driver for writing pixel data to pixels of the display panel 100, and a power supply 140 for generating power necessary for driving the pixels and the display panel driver.

The display panel 100 may have a rectangular structure having a length in an X-axis direction, a width in a Y-axis direction, and a thickness in a Z-axis direction. The display panel 100 includes a pixel array that displays an input image on a screen. The pixel array includes a plurality of data lines 102, a plurality of gate lines 103 intersecting the data lines 102, and pixels 101 arranged in a matrix form. The display panel 100 may further include power lines commonly connected to the pixels. The power lines supply the constant voltages EVDD, EVSS, Vref, and Vinit necessary for driving the pixels 101 to the pixels 101.

As shown in FIG. 24, the cross-sectional structure of the display panel 100 may include a circuit layer 12, a light emitting element layer 14, and an encapsulation layer 16 stacked on a substrate 10.

The circuit layer 12 may include a TFT array including a pixel circuit connected to wires such as the data line, the gate line, and the power line, a demultiplexer array 112, a gate driver 120, and the like. The wires and circuit elements of the circuit layer 12 may include a plurality of insulating layers, two or more metal layers separated with the insulating layer therebetween, and an active layer including a semiconductor material. All transistors formed in the circuit layer 12 may be implemented with n-channel oxide TFTs having a coplanar structure.

The light emitting element layer 14 may include a light emitting element EL driven by the pixel circuit. The light emitting element EL may include a red (R) light emitting element, a green (G) light emitting element, and a blue (B) light emitting element. In another embodiment, the light emitting element layer 14 may include a white light emitting element and a color filter. The light emitting elements EL of the light emitting element layer 14 may be covered with a protective layer including an organic film and a passivation film.

The encapsulation layer 16 covers the light emitting element layer 14 to seal the circuit layer 12 and the light emitting element layer 14. The encapsulation layer 16 may have a multi-insulating film structure in which an organic film and an inorganic film are alternately stacked. The inorganic film blocks the penetration of moisture and oxygen. The organic film planarizes the surface of the inorganic film. When the organic film and the inorganic film are stacked in multiple layers, the movement path of moisture or oxygen becomes longer than that in a single layer, so that the penetration of moisture and oxygen affecting the light emitting element layer 14 may be effectively blocked.

A touch sensor layer, which is omitted from the drawing, may be formed on the encapsulation layer 16, and a polarizing plate or a color filter layer may be disposed thereon. The touch sensor layer may include capacitive touch sensors that sense a touch input based on a change in capacitance before and after the touch input. The touch sensor layer may include insulating films and metal wiring patterns that form the capacitance of the touch sensors. The insulating films may insulate intersecting portions in the metal wiring patterns and may planarize the surface of the touch sensor layer. The polarizing plate may improve visibility and contrast ratio by converting the polarization of external light reflected by the metal of the circuit layer and the touch sensor layer. The polarizing plate may be implemented as a circular polarizing plate or a polarizing plate in which a linear polarizing plate and a step retardation film are bonded. A cover glass may be bonded to the polarizing plate. The color filter layer may include red, green, and blue color filters. The color filter layer may further include a black matrix pattern. The color filter layer may absorb a part of the wavelength of light reflected from the circuit layer and the touch sensor layer to replace the polarizing plate and increase the color purity of an image reproduced in the pixel array.

The pixel array includes a plurality of pixel lines L1 to Ln. Each of the pixel lines L1 to Ln includes one line of pixels arranged along a line direction (X-axis direction) in the pixel array of the display panel 100. The pixels arranged in one pixel line share the gate lines 103. Sub-pixels arranged in a column direction (Y-axis direction) along a data line direction share the same data line 102. One horizontal period is a time period obtained by dividing one frame period by the total number of the pixel lines L1 to Ln.

The display panel 100 may be implemented as a non-transmissive display panel or a transmissive display panel. The transmissive display panel may be applied to a transparent display device in which an image is displayed on a screen and an actual background is visible. The display panel 100 may be manufactured as a flexible display panel.

Each of the pixels 101 may be divided into a red sub-pixel, a green sub-pixel, and a blue sub-pixel to implement color. Each of the pixels may further include a white sub-pixel. Each of the sub-pixels may include the pixel circuit. Hereinafter, a pixel may be interpreted as having the same meaning as a sub-pixel. Each of the pixel circuits may be implemented with the circuits of the above-described embodiments.

The pixels may be arranged as real color pixels and pentile pixels. The pentile pixel may realize a higher resolution than that of a real color pixel by driving two sub-pixels having different colors as one pixel 101 by using a preset pixel rendering algorithm. The pixel rendering algorithm may compensate for insufficient color representation in each pixel with the color of light emitted from an adjacent pixel.

The power supply 140 generates a DC voltage (or constant voltage) necessary for driving the pixel array of the display panel 100 and the display panel driver by using a DC-DC converter. The DC-DC converter may include a charge pump, a regulator, a buck converter, a boost converter, and the like. The power supply 140 may adjust the level of a DC input voltage applied from a host system (not shown) to generate constant voltages such as a gamma reference voltage VGMA, the gate voltages VGH, VEH, VGL, and VEL, the pixel driving voltage EVDD, the pixel reference voltage EVSS, the initialization voltage Vinit, and the reference voltage Vref. The gamma reference voltage VGMA is supplied to a data driver 110. The gate voltages VGH, VEH, VGL, and VEL are supplied to the gate driver 120. The pixel driving voltage EVDD and the pixel reference voltage EVSS are supplied to the pixels 101 through the power lines commonly connected to the pixels 101.

The display panel driver writes the pixel data of the input image to the pixels of the display panel 100 under the control of a timing controller 130.

The display panel driver includes the data driver 110 and the gate driver 120. The display panel driver may further include a demultiplexer array 112 disposed between the data driver 110 and the data lines 102.

The demultiplexer array 112 sequentially supplies the data voltages outputted from the channels of the data driver 110 to the data lines 102 using a plurality of demultiplexers DEMUX. The demultiplexer may include a plurality of switch elements disposed on the display panel 100. When the demultiplexer is disposed between the data lines 102 and the output terminals of the data driver 110, the number of channels of the data driver 110 may be reduced. The demultiplexer array 112 may be omitted.

The display panel driver may further include a touch sensor driver for driving the touch sensors. The touch sensor driver is omitted from FIG. 23. The data driver 110 and the touch sensor driver may be integrated into one drive integrated circuit (IC). In a mobile device or a wearable device, the timing controller 130, the power supply 140, the data driver 110, and the like may be integrated into one drive IC.

The display panel driver may operate in a low speed driving mode under the control of the timing controller 130. The low speed driving mode may be set to reduce power consumption of the display device when the input image does not change by a preset number of frames as a result of analyzing the input image. In the low speed driving mode, power consumption of the display panel driver and the display panel 100 may be reduced by lowering a refresh rate of pixels when a still image is inputted for a predetermined time or over. The low speed driving mode is not limited to when a still image is inputted. For example, when the display device operates in a standby mode or when a user command or an input image is not inputted to the display panel driver for a predetermined time or over, the display panel driver may operate in the low speed driving mode.

The data driver 110 receives the pixel data, which is a digital signal, of the input image from the timing controller 130 and outputs a data voltage. The data driver 110 converts the pixel data of the input image into a gamma compensation voltage every frame period using a digital to analog converter (DAC) to generate a data voltage Vdata. The gamma reference voltage VGMA is divided into a gamma compensation voltage for each grayscale through a voltage divider circuit. The gamma compensation voltage for each grayscale is provided to the DAC of the data driver 110. The data voltage Vdata is outputted from each of the channels of the data driver 110 through an output buffer.

The gate driver 120 may be implemented with a gate in panel (GIP) circuit formed in a circuit layer 12 on the display panel 100 together with wires and the TFT array of the pixel array. The gate driver 120 may be disposed in a bezel area BZ, which is the non-display area of the display panel 100, or may be distributedly disposed in the pixel array where the input image is reproduced.

The gate driver 120 may, as shown in FIG. 23, be disposed in the bezel area BZ on one side of the display panel 100 to supply a gate pulse to the gate lines 103 in a single feeding method. In addition, the gate driver 120 may be disposed in the bezel areas BZ on both sides of the display panel 100 with the pixel array interposed therebetween and may supply the gate pulse Gout(N) to the gate lines 103 in a double feeding method.

The gate driver 120 sequentially outputs the gate pulse to the gate lines 103 under the control of the timing controller 130. The gate driver 120 may shift the gate pulse by using a shift register to sequentially supply the gate pulse to the gate lines 103.

The timing controller 130 receives digital video data DATA of the input image and a timing signal synchronized with the digital video data DATA from the host system. The timing signal may include a vertical synchronization signal Vsync, a horizontal synchronization signal Hsync, a clock CLK, a data enable signal DE, and the like. Since a vertical period and a horizontal period can be known by counting the data enable signal DE, the vertical synchronization signal Vsync and the horizontal synchronization signal Hsync may be omitted. The data enable signal DE has a cycle of one horizontal period 1H.

The host system may be any one of a television (TV) system, a tablet computer, a laptop computer, a navigation system, a personal computer (PC), a home theater system, a mobile device, a wearable device, and a vehicle system. The host system may scale an image signal from a video source to fit the resolution of the display panel 100 and transmit it to the timing controller 130 together with the timing signal.

In a normal driving mode, the timing controller 130 may multiply an input frame frequency by i (i being a natural number) times to control the operation timing of the display panel driver with a frame frequency of the input frame frequency×i Hz. The input frame frequency is 60 Hz in a national television standards committee (NTSC) system and 50 Hz in a phase-alternating line (PAL) system.

The timing controller 130 lowers the frame frequency (or the frame rate) at which pixel data is written to pixels in the low speed driving mode than in the normal driving mode. For example, the frame frequency at which pixel data is written into pixels in the normal driving mode may be generated at a refresh rate of any one of frequencies of 60 Hz or higher, e.g., 60 Hz, 120 Hz, and 144 Hz, and a data refresh frame DRF in the low speed driving mode may be generated at a refresh rate of a lower frame frequency than that in the normal driving mode. In order to lower the refresh rate of pixels in the low-speed driving mode, the timing controller 130 may lower the driving frequency of the display panel driver by lowering the frame frequency to a frequency between 1 Hz and 30 Hz.

Based on the timing signal Vsync, Hsync, and DE received from the host system, the timing controller 130 generates a data timing control signal for controlling the operation timing of the data driver 110, a control signal for controlling the operation timing of the demultiplexer array 112, and a gate timing control signal for controlling the operation timing of the gate driver 120. The timing controller 130 controls the operation timing of the display panel driver to synchronize the data driver 110, the demultiplexer array 112, the touch sensor driver, and the gate driver 120.

The gate timing control signal generated from the timing controller 130 may be inputted to the shift register of the gate driver 120 through a level shifter (not shown). The level shifter may receive the gate timing control signal to generate a start pulse and a shift clock, and provide them to the shift register of the gate driver 120.

The objects to be achieved by the present disclosure, the means for achieving the objects, and effects of the present disclosure described above do not specify essential features of the claims, and thus, the scope of the claims is not limited to the disclosure of the present disclosure.

It will be apparent to those skilled in the art that various modifications and variations can be made in the pixel circuit and the display device including the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. A pixel circuit, comprising:

a first driving element including a first electrode connected to a 1-1 th node, a gate electrode connected to a 1-2 th node, and a second electrode connected to a 1-3 th node; and a second driving element including a first electrode connected to a 2-1 th node, a gate electrode connected to a 2-2 th node, and a second electrode connected to a 2-3 th node, wherein a second electrode voltage of the first driving element is transmitted to the gate electrode of the second driving element, and a second electrode voltage of the second driving element is transmitted to the gate electrode of the first driving element.

2. The pixel circuit of claim 1, further comprising:

a first light emitting element;

a second light emitting element;

a 1-1 th switch element including a gate electrode to which a first scan pulse is applied, a first electrode connected to a 1-4 th node, and a second electrode connected to the 2-3 th node;

a 1-2 th switch element including a gate electrode to which the first scan pulse is applied, a first electrode to which a reference voltage is applied, and a second electrode connected to the 1-2 th node;

a 1-3 th switch element including a gate electrode to which the first scan pulse is applied, a first electrode to which an initialization voltage is applied, and a second electrode connected to an anode electrode of the first light emitting element;

a 1-4 th switch element including a gate electrode to which a second scan pulse is applied, a first electrode connected to a first data line, and a second electrode connected to the 1-4 th node;

a 1-5 th switch element including a gate electrode to which a first EM pulse is applied, a first electrode to which a pixel driving voltage is applied, and a second electrode connected to the 1-1 th node;

a 1-6 th switch element including a gate electrode to which a second EM pulse is applied, a first electrode connected to the 1-3 th node, and a second electrode connected to the anode electrode of the first light emitting element;

a 2-1 th switch element including a gate electrode to which the first scan pulse is applied, a first electrode connected to a 2-4 th node, and a second electrode connected to the 1-3 th node;

a 2-2 th switch element including a gate electrode to which the first scan pulse is applied, a first electrode to which the reference voltage is applied, and a second electrode connected to the 2-2 th node;

a 2-3 th switch element including a gate electrode to which the first scan pulse is applied, a first electrode to which the initialization voltage is applied, and a second electrode connected to an anode electrode of the second light emitting element;

a 2-4 th switch element including a gate electrode to which the second scan pulse is applied, a first electrode connected to a second data line, and a second electrode connected to the 2-4 th node;

a 2-5 th switch element including a gate electrode to which the first EM pulse is applied, a first electrode to which the pixel driving voltage is applied, and a second electrode connected to the 2-1 th node; and a 2-6 th switch element including a gate electrode to which the second EM pulse is applied, a first electrode connected to the 2-3 th node, and a second electrode connected to the anode electrode of the second light emitting element.

3. The pixel circuit of claim 2, further comprising:

a 1-7 th switch element including a gate electrode to which a third EM pulse is applied, a first electrode connected to the 2-3 th node, and a second electrode connected to the anode electrode of the first light emitting element; and a 2-7th switch element including a gate electrode to which the third EM pulse is applied, a first electrode connected to the 1-3 th node, and a second electrode connected to the anode electrode of the second light emitting element.

4. The pixel circuit of claim 3, wherein a first driving period of the pixel circuit includes an initialization step, a sensing step, a data writing step, a boosting step, and an light emission step, wherein in the initialization step of the first driving period, the first scan pulse and the second EM pulse are generated at gate-on voltages, and the second scan pulse, the first EM pulse, and the third EM pulse are at gate-off voltages, in the sensing step of the first driving period, the first scan pulse and the first EM pulse are generated at the gate-on voltages, and the second scan pulse, the second EM pulse, and the third EM pulse are at the gate-off voltages, in the data writing step of the first driving period, the second scan pulse is generated at the gate-on voltage synchronized with a data voltage applied to the first and second data lines, and the first scan pulse, the first EM pulse, the second EM pulse, and the third EM pulse are at the gate-off voltages, and in the boosting step and the light emission step of the first driving period, the first EM pulse and the second EM pulse are at the gate-on voltages, and the first scan pulse, the second scan pulse, and the third EM pulse are at the gate-off voltages, and the switch elements are turned on in response to the gate-on voltage and turned off in response to the gate-off voltage, and a first data voltage is applied to the first data line and a second data voltage is applied to the second data line during the first driving period.

5. The pixel circuit of claim 4, wherein a second driving period of the pixel circuit includes an initialization step, a sensing step, a data writing step, a boosting step, and an light emission step, wherein in the initialization step of the second driving period, the first scan pulse and the third EM pulse are generated at a gate-on voltage, and the second scan pulse, the first EM pulse, and the second EM pulse are at a gate-off voltage, in the sensing step of the second driving period, the first scan pulse and the first EM pulse are generated at the gate-on voltage, and the second scan pulse, the second EM pulse, and the third EM pulse are at the gate-off voltage, in the data writing step of the second driving period, the second scan pulse is generated at the gate-on voltage synchronized with the data voltage applied to the first and second data lines, and the first scan pulse, the first EM pulse, the second EM pulse, and the third EM pulse are at the gate-off voltage, and in the boosting step and the light emission step of the second driving period, the first EM pulse and the third EM pulse are at the gate-on voltage, and the first scan pulse, the second scan pulse, and the second EM pulse are at the gate-off voltage, and the second data voltage is applied to the first data line and the first data voltage is applied to the second data line during the second driving period.

6. The pixel circuit of claim 2, wherein a pixel reference voltage is applied to cathode electrodes of the first and second light emitting elements, the pixel driving voltage is higher than a maximum voltage of a data voltage applied to the first and second data lines, the reference voltage is lower than a minimum voltage of the data voltage, and the pixel reference voltage and the initialization voltage are lower than the reference voltage.

7. The pixel circuit of claim 2, further comprising:

a 1-1 th capacitor connected between the 1-2 th node and the 1-4 th node;

a 1-2 th capacitor connected between the 1-2 th node and the 1-3 th node or between the 1-4 th node and the 1-3 th node;

a 2-1 th capacitor connected between the 2-2 th node and the 2-4 th node; and a 2-2 th capacitor connected between the 2-2 th node and the 2-3 th node or between the 2-4 th node and the 2-3 th node.

8. The pixel circuit of claim 1, further comprising:

a first light emitting element;

a second light emitting element;

a 1-1 th switch element including a gate electrode to which a scan pulse is applied, a first electrode connected to a 1-4 th node, and a second electrode connected to the 2-3 th node;

a 1-2 th switch element including a gate electrode to which the scan pulse is applied, a first electrode to which a first data voltage is applied, and a second electrode connected to the 1-2 th node;

a 1-3 th switch element including a gate electrode to which the scan pulse is applied, a first electrode to which an initialization voltage is applied, and a second electrode connected to an anode electrode of the first light emitting element;

a 1-4 th switch element including a gate electrode to which an EM pulse is applied, a first electrode connected to the 1-3 th node, and a second electrode connected to the anode electrode of the first light emitting element;

a 2-1 th switch element including a gate electrode to which the scan pulse is applied, a first electrode connected to a 2-4 th node, and a second electrode connected to the 1-3 th node;

a 2-2 th switch element including a gate electrode to which the scan pulse is applied, a first electrode to which a second data voltage is applied, and a second electrode connected to the 2-2 th node;

a 2-3 th switch element including a gate electrode to which the scan pulse is applied, a first electrode to which the initialization voltage is applied, and a second electrode connected to an anode electrode of the second light emitting element;

a 2-4 th switch element including a gate electrode to which the EM pulse is applied, a first electrode connected to the 2-3 th node, and a second electrode connected to the anode electrode of the second light emitting element;

a 1-1 th capacitor connected between the 1-2 th node and the 1-4 th node;

a 1-2 th capacitor connected between the 1-2 th node and the 1-3 th node or between the 1-4 th node and the 1-3 th node;

a 2-1 th capacitor connected between the 2-2 th node and the 2-4 th node; and a 2-2 th capacitor connected between the 2-2 th node and the 2-3 th node or between the 2-4 th node and the 2-3 th node.

9. The pixel circuit of claim 8, wherein a pixel reference voltage is applied to cathode electrodes of the first and second light emitting elements, a pixel driving voltage is higher than a maximum voltage of the first and second data voltages, and the pixel reference voltage and the initialization voltage are lower than a minimum voltage of the first and second data voltages.

10. The pixel circuit of claim 8, wherein a driving period of the pixel circuit includes an initialization step, a sensing step, a data writing step, a boosting step, and an light emission step, wherein in the initialization step, the scan pulse and the EM pulse are generated at gate-on voltages, in the sensing step, the scan pulse is generated at the gate-on voltage, the EM pulse is at a gate-off voltage, in the data writing step, the scan pulse is generated at the gate-on voltage synchronized with the first and second data voltages, and the EM pulse is at the gate-off voltage, and in the boosting step and the light emission step, the EM pulse is generated at the gate-on voltage, and the scan pulse is at the gate-off voltage, and the switch elements are turned on in response to the gate-on voltage and turned off in response to the gate-off voltage.

11. A display device, comprising:

a display panel on which a plurality of data lines, a plurality of gate lines, a plurality of power lines, and a plurality of pixels are arranged;

a data driver configured to convert pixel data into data voltages and supply them to the data lines; and a gate driver configured to supply a gate pulse to the gate lines, wherein a first pixel in the plurality of pixels includes a first driving element including a first electrode connected to a 1-1 th node, a gate electrode connected to a 1-2 th node, and a second electrode connected to a 1-3 th node, a second pixel adjacent to the first pixel in the plurality of pixels includes a second driving element including a first electrode connected to a 2-1 th node, a gate electrode connected to a 2-2 th node, and a second electrode connected to a 2-3 th node, wherein a second electrode voltage of the first driving element is transmitted to the gate electrode of the second driving element, and a second electrode voltage of the second driving element is transmitted to the gate electrode of the first driving element.

12. The display device of claim 11, wherein the gate pulse includes a first scan pulse, a second scan pulse, a first EM pulse, and a second EM pulse, and the first pixel further includes:

a first light emitting element;

a 1-1 th switch element including a gate electrode to which the first scan pulse is applied, a first electrode connected to a 1-4 th node, and a second electrode connected to the 2-3 th node;

a 1-2 th switch element including a gate electrode to which the first scan pulse is applied, a first electrode to which a reference voltage is applied, and a second electrode connected to the 1-2 th node;

a 1-3 th switch element including a gate electrode to which the first scan pulse is applied, a first electrode to which an initialization voltage is applied, and a second electrode connected to an anode electrode of the first light emitting element;

a 1-4 th switch element including a gate electrode to which the second scan pulse is applied, a first electrode connected to a first data line in the plurality of data lines, and a second electrode connected to the 1-4 th node;

a 1-5 th switch element including a gate electrode to which the first EM pulse is applied, a first electrode to which a pixel driving voltage is applied, and a second electrode connected to the 1-1 th node;

a 1-6 th switch element including a gate electrode to which the second EM pulse is applied, a first electrode connected to the 1-3 th node, and a second electrode connected to the anode electrode of the first light emitting element;

a 1-1 th capacitor connected between the 1-2 th node and the 1-4 th node; and a 1-2 th capacitor connected between the 1-2 th node and the 1-3 th node or between the 1-4 th node and the 1-3 th node, and the second pixel further includes:

a second light emitting element;

a 2-1 th switch element including a gate electrode to which the first scan pulse is applied, a first electrode connected to a 2-4 th node, and a second electrode connected to the 1-3 th node;

a 2-2 th switch element including a gate electrode to which the first scan pulse is applied, a first electrode to which the reference voltage is applied, and a second electrode connected to the 2-2 th node;

a 2-3 th switch element including a gate electrode to which the first scan pulse is applied, a first electrode to which the initialization voltage is applied, and a second electrode connected to an anode electrode of the second light emitting element;

a 2-4 th switch element including a gate electrode to which the second scan pulse is applied, a first electrode connected to a second data line in the plurality of data lines, and a second electrode connected to the 2-4 th node;

a 2-5 th switch element including a gate electrode to which the first EM pulse is applied, a first electrode to which the pixel driving voltage is applied, and a second electrode connected to the 2-1 th node;

a 2-6 th switch element including a gate electrode to which the second EM pulse is applied, a first electrode connected to the 2-3 th node, and a second electrode connected to the anode electrode of the second light emitting element;

a 2-1 th capacitor connected between the 2-2 th node and the 2-4 th node; and a 2-2 th capacitor connected between the 2-2 th node and the 2-3 th node or between the 2-4 th node and the 2-3 th node.

13. The display device of claim 12, wherein the gate pulse further includes a third EM pulse, the first pixel further includes a 1-7 th switch element including a gate electrode to which the third EM pulse is applied, a first electrode connected to the 2-3 th node, and a second electrode connected to the anode electrode of the first light emitting element, and the second pixel further includes a 2-7 th switch element including a gate electrode to which the third EM pulse is applied, a first electrode connected to the 1-3 th node, and a second electrode connected to the anode electrode of the second light emitting element.

14. The display device of claim 13, wherein a first driving period of the first and second pixels includes an initialization step, a sensing step, a data writing step, a boosting stage, and an light emission step, wherein in the initialization step of the first driving period, the first scan pulse and the second EM pulse are generated at a gate-on voltage, and the second scan pulse, the first EM pulse, and the third EM pulse are at a gate-off voltage, in the sensing step of the first driving period, the first scan pulse and the first EM pulse are generated at the gate-on voltage, and the second scan pulse, the second EM pulse, and the third EM pulse are at the gate-off voltage, in the data writing step of the first driving period, the second scan pulse is generated at the gate-on voltage synchronized with a data voltage applied to the data lines, and the first scan pulse, the first EM pulse, the second EM pulse, and the third EM pulse are at the gate-off voltage, and in the boosting step and the light emission step of the first driving period, the first EM pulse and the second EM pulse are at the gate-on voltage, and the first scan pulse, the second scan pulse, and the third EM pulse are at the gate-off voltages, and the switch elements are turned on in response to the gate-on voltage and turned off in response to the gate-off voltage, and a first data voltage is applied to the first data line, and a second data voltage is applied to the second data line during the first driving period.

15. The display device of claim 14, wherein a second driving period of the first and second pixels includes an initialization step, a sensing step, a data writing step, a boosting stage, and an light emission step, wherein in the initialization step of the second driving period, the first scan pulse and the third EM pulse are generated at a gate-on voltage, and the second scan pulse, the first EM pulse, and the second EM pulse are at a gate-off voltage, in the sensing step of the second driving period, the first scan pulse and the first EM pulse are generated at the gate-on voltage, and the second scan pulse, the second EM pulse, and the third EM pulse are at the gate-off voltage, in the data writing step of the second driving period, the second scan pulse is generated at the gate-on voltage synchronized with the data voltage applied to the data lines, and the first scan pulse, the first EM pulse, the second EM pulse, and the third EM pulse are at the gate-off voltage, and in the boosting step and the light emission step of the second driving period, the first EM pulse and the third EM pulse are at the gate-on voltage, and the first scan pulse, the second scan pulse, and the second EM pulse are at the gate-off voltage, and the second data voltage is applied to the first data line, and the first data voltage is applied to the second data line during the second driving period.

16. The display device of claim 12, wherein a pixel reference voltage is applied to cathode electrodes of the first and second light emitting elements, the pixel driving voltage is higher than a maximum voltage of a data voltage applied to the data lines, and the reference voltage is lower than a minimum voltage of the data voltage, and the pixel reference voltage and the initialization voltage are lower than the reference voltage.

17. The display device of claim 11, wherein the gate pulse includes a scan pulse and an EM pulse, and the first pixel further includes:

a first light emitting element;

a 1-1 th switch element including a gate electrode to which the scan pulse is applied, a first electrode connected to a 1-4 th node, and a second electrode connected to the 2-3 th node;

a 1-2 th switch element including a gate electrode to which the scan pulse is applied, a first electrode to which a first data voltage is applied, and a second electrode connected to the 1-2 th node;

a 1-3 th switch element including a gate electrode to which the scan pulse is applied, a first electrode to which an initialization voltage is applied, and a second electrode connected to an anode electrode of the first light emitting element;

a 1-4 th switch element including a gate electrode to which the EM pulse is applied, a first electrode connected to the 1-3 th node, and a second electrode connected to the anode electrode of the first light emitting element;

a 1-1 th capacitor connected between the 1-2 th node and the 1-4 th node; and a 1-2 th capacitor connected between the 1-2 th node and the 1-3 th node or between the 1-4 th node and the 1-3 th node, and the second pixel further includes:

a second light emitting element;

a 2-1 th switch element including a gate electrode to which the scan pulse is applied, a first electrode connected to a 2-4 th node, and a second electrode connected to the 1-3 th node;

a 2-2 th switch element including a gate electrode to which the scan pulse is applied, a first electrode to which a second data voltage is applied, and a second electrode connected to the 2-2 th node;

a 2-3 th switch element including a gate electrode to which the scan pulse is applied, a first electrode to which the initialization voltage is applied, and a second electrode connected to an anode electrode of the second light emitting element;

a 2-4 th switch element including a gate electrode to which the EM pulse is applied, a first electrode connected to the 2-3 th node, and a second electrode connected to the anode electrode of the second light emitting element;

a 2-1 th capacitor connected between the 2-2 th node and the 2-4 th node; and a 2-2 th capacitor connected between the 2-2 th node and the 2-3 th node or between the 2-4 th node and the 2-3 th node.

18. The display device of claim 17, wherein a pixel reference voltage is applied to cathode electrodes of the first and second light emitting elements, a pixel driving voltage is higher than a maximum voltage of the first and second data voltages, and the pixel reference voltage and the initialization voltage are lower than a minimum voltage of the first and second data voltages.

19. The display device of claim 17, wherein a driving period of the first and second pixels includes an initialization step, a sensing step, a data writing step, a boosting step, and an light emission step, wherein in the initialization step, the scan pulse and the EM pulse are generated at a gate-on voltage, in the sensing step, the scan pulse is generated at the gate-on voltage, the EM pulse is at a gate-off voltage, in the data writing step, the scan pulse is generated at the gate-on voltage synchronized with the first and second data voltages, and the EM pulse is at the gate-off voltage, and in the boosting step and the light emission step, the EM pulse is generated at the gate-on voltage, and the scan pulse is at the gate-off voltage, and the switch elements are turned on in response to the gate-on voltage and turned off in response to the gate-off voltage.

20. The display device of claim 11, wherein when threshold voltages of the first and second driving elements are sensed, the threshold voltages of the first and second driving elements are able to be sensed at a voltage less than 0 V, and when threshold voltages of the first and second driving elements are sensed, the threshold voltage of the first driving element is transmitted to the 2-2 th node, the threshold voltage of the second driving element is transmitted to the 1-2 th node.

* * * * *